US006132523A

United States Patent [19]

Okuda et al.

[11] Patent Number: 6,132,523

[45] Date of Patent: Oct. 17, 2000

[54] METHOD OF CLEANING A SUBSTRATE IN A CLEANING TANK USING PLURAL FLUID FLOWS

[75] Inventors: Tohru Okuda, Nara; Taimi Oketani; Masatoshi Hayashi, both of Matsusaka; Yasuhiro Matsushima, Kashihara, all of Japan

[73] Assignee: Sharp Kabushiki Kaisha, Osaka, Japan

[21] Appl. No.: 09/145,970

[22] Filed: Sep. 3, 1998

[30] Foreign Application Priority Data

Sep. 19, 1997 [JP] Japan ..... 9-255577
Dec. 25, 1997 [JP] Japan ..... 9-356484

[51] Int. Cl.[7] ..... B08B 3/02; B08B 3/04

[52] U.S. Cl. ..... 134/36; 134/10; 134/186; 134/199

[58] Field of Search ..... 134/10, 36, 155, 134/186, 199

[56] References Cited

U.S. PATENT DOCUMENTS 5,860,361 1/1999 Nanjyo et al. ..... 134/199
5,937,878 8/1999 Cheng ..... 134/111

FOREIGN PATENT DOCUMENTS 8-290134 11/1996 Japan .

*Primary Examiner*—Zeinab El-Arini
*Attorney, Agent, or Firm*—Nixon & Vanderhye, P.C.

[57] ABSTRACT

A cleaning apparatus and method in accordance with the present invention includes a first inflow section, provided on a first side surface of a cleaning tank having a substantially rectangular parallelopiped shape, having two inflow openings, a second inflow section, provided on a second side surface facing the first side surface, having inflow openings, and outflow openings for releasing a cleaning liquid flown in from the first and second inflow sections. The cleaning liquid flowing in from the inflow openings forms complex and strong flows in the cleaning tank, thus removing contaminants on a cleaning target evenly and efficiently without nonuniformity and preventing stagnation of the cleaning liquid in the cleaning tank. The cleaning liquid released in filtered by a circulatory section and is allowed to flow into the cleaning tank again through a pipe. As a result, it is possible to clean evenly and efficiently a large cleaning target such as a glass substrate used for liquid crystal display devices and other devices.

10 Claims, 17 Drawing Sheets

METHOD OF CLEANING A SUBSTRATE IN A CLEANING TANK USING PLURAL FLUID FLOWS

FIELD OF THE INVENTION

The present invention relates to a cleaning apparatus for cleaning substrates such as glass substrates, and particularly to a cleaning method and a cleaning apparatus suitable for cleaning a large substrate having a size of not less than 400 mm×400 mm.

BACKGROUND OF THE INVENTION

A liquid crystal display device has such an advantage, compared with other display devices, that the dimension of the depth (thickness) can be made significantly thinner, power consumption is low, and a full-color image can be obtained with ease, and therefore has been applied in a wide variety of fields in recent years. The liquid crystal display device generally has a structure wherein a liquid crystal layer is sandwiched between a pair of glass substrates.

With respect to the glass substrates, a transparent conductive layer, an organic high polymer film, and a thin film such as a metallic film are deposited, and by patterning of these films, switching elements such as TFT (Thin Film Transistors) and wiring for driving and controlling the switching elements are formed.

In the process of forming such films, it is required to remove particles of submicrons to several microns adhering on the glass substrates by cleaning the substrates. This is because when the thin films are formed while the particles still remain on the glass substrates, wiring defect such as breakage and leaking of wire occurs in the wiring formed by patterning the thin films. The wiring defect induces malfunctioning of the switching elements, which might cause a line defect or dot defect in the product liquid crystal display device. The same problem is also presented in manufacturing of ICs and LSIs.

In order to solve this problem, it has been a common practice to remove the particles on the substrates by cleaning the substrates such as glass substrates in a cleaning apparatus, and thereafter deposit thin films on the substrates. As such a cleaning apparatus, a cleaning apparatus of the overflow system is available, in which a cleaning liquid flows into a cleaning tank substantially uniformly. A cleaning apparatus 100 as shown in FIG. 7 is an example of such a cleaning apparatus, which includes at least a pump 101, a filter 102, a cleaning tank 103, an inflow opening 105, releasing means 106, and a punching plate 107.

In this cleaning apparatus 100, first, the particles contained in the cleaning liquid which has been forced out by the pump 101 are removed by the filter 102. The cleaning liquid from which the particles are removed flows into the cleaning tank 103 through the inflow opening 105 provided in a flat manner on a bottom surface of the cleaning tank 103. Above the inflow opening 105 is provided the punching plate 107 which smooths the flow of the cleaning liquid, and as a result the cleaning liquid flows into the cleaning tank 103 uniformly.

In the cleaning tank 103, a plurality of substrates 104 (for example, glass substrates) are placed as a cleaning target, and the substrates 104 are cleaned by the cleaning liquid flowing uniformly. The cleaning liquid is released by the releasing means 106 through outflow openings (not shown) provided on the cleaning tank 103.

As described, the inflow opening 105 is provided in a flat manner on the bottom surface of the cleaning tank 103, and since the punching plate 107 is provided, as shown in FIG. 8, the cleaning liquid flows into the cleaning tank 103 uniformly. The cleaning liquid then flows from the lower portion of the cleaning tank 103 towards the upper portion where two outflow openings 108 are provided. The substrates 104 are cleaned by this flow of the cleaning liquid. Thereafter, as described above, the cleaning liquid flows out from the outflow openings 108 provided so as to contact the upper ends of the cleaning tank 103, and is released by the releasing means 106.

As the cleaning apparatus of the overflow system, other than the cleaning apparatus 100 as described above, the following cleaning apparatuses are available. In a cleaning apparatus 110, as shown in FIG. 9, the cleaning liquid flows in the form of radial distribution into a cleaning tank 113 from inflow openings 115 provided in a flat manner on the bottom surface of the cleaning tank 113. The cleaning liquid flowing in this manner cleans the substrates 104 and then flows out from two outflow openings 118 provided on the side surfaces of the cleaning tank 113, contacting the upper surface.

In a cleaning apparatus 120, as shown in FIG. 10, flat inflow openings 125 are provided on the upper surface of a cleaning tank 123, and the cleaning liquid flows in uniformly from the inflow openings 125. The cleaning liquid flowing in this manner cleans the substrates 104 and then flows out from two outflow openings 128 provided on the side surfaces of the cleaning tank 123 so as to contact the bottom surface.

Also, a cleaning apparatus in which a cleaning liquid which has flown into the cleaning apparatus flows out from a plurality of inflow openings is available. Namely, in this cleaning apparatus, the arrangement of the inflow openings and the outflow openings is opposite to that of the cleaning apparatus of the overflow system. For example, as shown in FIG. 11, in a cleaning apparatus 130, the cleaning liquid flows in from inflow openings 135 provided on the side surfaces of a cleaning tank 133, contracting the upper surface. The cleaning liquid flowing in this manner cleans the substrates 104 and then uniformly flows out from flat outflow openings 138 provided on the bottom surface of the cleaning tank 133.

As such a cleaning apparatus of the uniform flow system, especially as a cleaning apparatus for cleaning a silicon wafer which is a circular substrate used for ICs and LSIs, for example, as shown in FIG. 12, a cleaning apparatus 140 including a cleaning tank 143 having a cross section of substantially semicircular shape is available.

In this cleaning apparatus 140, the shape of the cleaning tank 143 is set in accordance with the shape of a silicon wafer 144 provided as a cleaning target. On the upper portion of the cleaning tank 143, there is provided a pure water supplying section 142 for supplying pure water (cleaning liquid), and inside the cleaning tank 143 are provided a plurality of shower pipes for spraying pure water onto a position corresponding to the shape of the silicon wafer 144. Spraying of pure water by the shower pipes stirs the pure water in the cleaning tank 143, and the particles on the silicon wafer 144 are removed. Thereafter, the pure water is uniformly flown out from outflow openings 148 so as to be released.

As another example of the cleaning apparatus having the described arrangement, a cleaning apparatus as disclosed in Japanese Unexamined Patent publication No. 290134/1996 (Tokukaihei 8-290134) is available. In this cleaning apparatus 150, as shown in FIG. 13, two inflow openings 155 are provided on the upper end of one of the side surfaces of a cleaning tank 153 having substantially a rectangular parallelopiped shape so that the inflow angles of the pure water (cleaning liquid) are different. The flows of the pure water flown from the two inflow openings 155 remove the particles on the silicon wafer 144 (cleaning target), and thereafter merge into a single flow in the vicinity of flat outflow openings 158 provided on the bottom surface of the cleaning tank 153, thus cancelling out the flows. The pure water in which the flows have been cancelled out in this manner flows out through the outflow openings 158 so as to be released.

Meanwhile, a cleaning apparatus of the tornado system in which the cleaning liquid flown in from a plurality of inflow openings flows out from a single or plurality of outflow openings is known. As such a cleaning apparatus of the tornado system, for example, a cleaning apparatus 160 as shown in FIG. 14 is available, in which two inflow openings 165 are provided on the side surfaces of a cleaning tank 163 so as to contact the upper surface, and a single outflow opening 168 is provided so as to contact the bottom surface of the cleaning tank 163. In this cleaning apparatus 160, the substrates 104 are cleaned by the swirl formed by the cleaning liquid flown into the cleaning tank 163 from the two inflow openings 165, and the cleaning liquid flows out from the outflow opening 168 so as to be released.

Also, a cleaning apparatus as shown in FIG. 15 is available, in which two inflow openings 175 are provided on the side surfaces contacting the upper surface of a cleaning tank 173, and two outflow openings 178 are provided on the side surfaces contacting the bottom surface of the cleaning tank 173. In the cleaning apparatus 170, the substrates 104 are also cleaned by the swirl formed by the flows of the cleaning liquid in the cleaning tank 173.

The above cleaning apparatuses clean the substrates 104 in the described manners and the particles adhering on the substrates 104 are removed.

However, in the cleaning apparatus 100 of the overflow system, the cleaning liquid uniformly flowing in from the inflow openings 105 faces the viscous resistance by the substrates 104 (cleaning target). As a result, the flows of the cleaning liquid diverge towards the sides where the two outflow openings 108 are provided in their way up towards the upper portion of the cleaning tank 103. Thus, at the central portion of the cleaning tank 103 in the vicinity of the fluid surface where the cleaning liquid diverges, stagnation of the cleaning liquid is generated, and the particles reside in the stagnation thus generated (generation of residual particles).

When residual particles are generated in this manner, large numbers of particles remain particularly in a region on the substrates 104 placed in the cleaning tank 103, corresponding to the stagnated portion. Thus, on the substrates 104, two regions of (A) a contaminated region in which a large number of particles remain and contamination due to the particles is present and (B) a clean region in which the number of residual particles is less than a predetermined number are formed. As a result, nonuniformity in the number of residual particles is generated on the substrates 104.

Therefore, in order to evenly clean the substrates 104 with respect to the entire surfaces by the cleaning apparatus 100, it is required to continue cleaning until the number of residual particles in the contaminated region substantially equals the number of residual particles in the clean region. For this reason, it takes a long time to clean the entire surfaces of the substrates 104.

Further, another problem is presented that when taking the glass substrates 104 out of the cleaning tank 103 after cleaning, the particles remaining in the stagnation of the cleaning liquid adhere again onto the cleaned substrates 104, and the substrates 104 are re-contaminated.

In the cleaning apparatus 110, since the flows of the cleaning liquid are distributed radially, the amount of the cleaning liquid flowing towards the central portion in the vicinity of the fluid surface is large in the cleaning tank 113. Therefore, even though the residual particles are prevented from generating at the central portion to some degree, it is impossible to completely prevent generation of residual particles, and the above problems remain unsolved.

Likewise, in the cleaning apparatus of the overflow system such as the cleaning apparatus 120 in which the cleaning liquid flows uniformly into the cleaning tank 123 from above, the cleaning liquid diverges towards the sides on the lower portion of the cleaning tank 123 where the two outflow openings 128 are provided. Thus, the cleaning liquid stagnates where the cleaning liquid diverges, and the generation of residual particles cannot be prevented.

Also, in the cleaning apparatus 130 of the uniform outflow system, the flows of the cleaning liquid from the two inflow openings 135 form a large swirl in the cleaning tank 133. When the cleaning liquid forms a swirl in this manner, the flows of the cleaning liquid are weakened. Thus, in the cleaning apparatus 130, unlike the cleaning apparatus of the overflow system, no stagnation of the cleaning liquid is formed in the cleaning tank 133. However, since the flows of the cleaning liquid are weak, the particles on the substrates 104 cannot be removed effectively, and it takes a long time to clean the entire surfaces of the substrates 104.

In the cleaning apparatus 140 having the same arrangement as that of the cleaning apparatus 130, pure water is supplied from the upper portion of the cleaning tank 143, and the pure water is sprayed on the periphery of the silicon wafer 144 at the central portion of the cleaning tank 143. Thus, although the silicon wafer 144 is cleaned sufficiently, because the pure water is stirred in the central portion of the cleaning tank 143, the particles removed by cleaning are not released immediately from the outflow openings 148 and remain in the cleaning tank 143.

Also, in the cleaning apparatus 150 as disclosed in Japanese Unexamined Patent publication No. 290134/1996 (Tokukaihei 8-290134), the flows of pure water are cancelled out in the vicinity of the outflow openings 158. Thus, the particles removed do not remain in the cleaning tank 158 and are immediately released from the outflow openings 158, solving the problem of the cleaning apparatus 140. However, as shown in FIG. 13, by the pure water flowing in from the two inflow openings 155, stagnation is generated in a region as indicated by the arrow A in the upper portion of the cleaning tank 153.

In the cleaning apparatus 150, because the silicon wafer 144 used as a cleaning target is not as large as a glass substrate used for liquid crystal display devices, the effect of stagnation on cleaning is not as significant. However, when the size of the cleaning target is increased as large as the glass substrate, as in the cleaning apparatus of the overflow system, residual particles are generated by stagnation, and the cleaning effect is lowered significantly.

In the cleaning apparatuses 160 and 170, as in the cleaning apparatus 130, since the flows of the cleaning liquid form a large swirl, stagnation of the cleaning liquid is prevented in the cleaning tanks 163 and 173. However, the flows of the cleaning liquid forming a large swirl are not sufficient for cleaning the substrates 104, and the particles on the substrates 104 are not removed efficiently.

Also, as the inflow openings of the described cleaning apparatuses, a nozzle having opening sections has been adopted widely. However, almost no consideration had been given to the shape of the nozzle and the inflow amount of the cleaning liquid for allowing the particles to be removed most efficiently in the shortest period of time.

SUMMARY OF THE INVENTION

The present invention offers a solution to the above-mentioned problems, and accordingly it is an object of the present invention to provide a cleaning method and a cleaning apparatus which prevent stagnation of a cleaning liquid in a cleaning tank, and are capable of efficiently cleaning a large cleaning target placed in the cleaning tank, in particular, glass substrates used for liquid crystal display devices, by forming flows of the cleaning liquid with a sufficient force for removing particles in the entire cleaning tank.

It is another object of the present invention to provide a cleaning method and a cleaning apparatus in which the shape of opening sections and the flow amount of a cleaning liquid are optimized so as to remove the particles adhering on substrates placed in a cleaning tank in a short period of time, prevent lowering of the quality of the cleaning target as caused by adhering of the particles, and improve the throughput in a cleaning process.

In order to achieve the above-mentioned objects, a cleaning method in accordance with the present invention is characterized in that a fluid flows into a cleaning tank having a substantially rectangular parallelopiped shape from a first side surface of the cleaning tank and from a second side surface facing the first side surface towards a cleaning target stored in the cleaning tank, the fluid being released out of the cleaning tank after cleaning the cleaning target, wherein the fluid flowing in from at least one of the first side surface and the second side surface is plural.

With this method, the fluid forms a plurality of counter flows with respect to the cleaning target. Therefore, in the cleaning tank, the flows of the fluid become more complex without cancelling out the momentum. As a result, in the cleaning tank, since the fluid forms more complex and stronger flows than the conventional ones, the contaminants on the cleaning target are removed substantially evenly without nonuniformity.

In order to achieve the above-mentioned objects, another cleaning method in accordance with the present invention is characterized in that a fluid flows in towards a cleaning target stored by being inclined in a cleaning tank having a substantially rectangular parallelopiped shape from a position in a region on a first side surface in a vicinity of an upper end of the cleaning target, the region corresponding to a distance between the upper end and a lower end of the cleaning target, the fluid also flowing in from a position on a second side surface facing the first side surface, in a vicinity of the lower end of the cleaning target, the fluid being released out of the cleaning tank after cleaning the cleaning target from a plurality of outflow openings provided on an upper end of the cleaning tank, wherein the fluid flowing in from at least one of the first side surface and the second side surface is plural.

With this method, in the cleaning tank, the fluid forms a flow on the first side surface of the cleaning tank directly beside the cleaning target and a flow on the second side surface facing the first side surface in the vicinity of the bottom surface of the cleaning tank. Therefore, in the cleaning tank, more complex and stronger flows of the fluid are formed, thus preventing stagnation of the fluid in the cleaning tank, and cleaning a large cleaning target more efficiently.

In order to achieve the above-mentioned objects, yet another cleaning method in accordance with the present invention is characterized in that a fluid flows in from side surfaces of a cleaning tank towards a cleaning target stored in the cleaning tank, wherein the fluid flows in from an inflow opening having a plurality of opening sections, the plurality of opening sections each having a shape selected from the group consisting of a circle with a diameter in a range of not less than 2 mm to not more than 5 mm and a rectangle with a side length in a range of not less than 2 mm to not more than 5 mm.

With this method, stagnation of the fluid in the cleaning tank is prevented with more certainty, and the fluid forms flows with a momentum strong enough for removing the particles in the entire cleaning tank. Therefore, with this cleaning method, it is possible to clean efficiently a large cleaning target such as a glass substrate used for liquid crystal display devices.

In order to achieve the above-mentioned objects, a cleaning apparatus in accordance with the present invention is characterized by including:

a cleaning tank having a substantially rectangular parallelopiped shape with a region for storing a cleaning target;

a first inflow section, provided on a first side surface of the cleaning tank, for allowing a fluid to flow into the cleaning tank;

a second inflow section, provided on a second side surface facing the first side surface, for allowing the fluid to flow into the cleaning tank; and an outflow opening for releasing the fluid flowing in from the first inflow section and the second inflow section, wherein at least one of the first inflow section and the second inflow section has a plurality of inflow openings whose heights from a bottom surface of the cleaning tank are different from one another.

A common cleaning apparatus is arranged in such a manner that the fluid forms a predetermined large flow in the cleaning tank, and the fluid tends to flow in a simple manner in the cleaning tank. In this simple and large flow, the fluid flows only weakly, and in a region outside this simple and large flow, stagnation of the fluid is more likely to occur.

In contrast, in the described arrangement of the cleaning apparatus of the present invention, the fluid forms at least three flows which encounter one another. This arrangement allows the fluid to form even more complex flows in the cleaning tank without cancelling out the momentum of the flows.

Namely, in the cleaning tank, the fluid is prevented from forming a predetermined large flow but instead forms stronger and more complex flows than the conventional ones. As a result, it is possible to effectively prevent stagnation of the cleaning liquid and simple weak flows of the fluid forming a large swirl in the cleaning tank.

Thus, the particles adhering on the cleaning target are removed with time substantially evenly and efficiently by the strong and complex flows without generating significant nonuniformity on the entire surfaces of the cleaning target. Further, because the fluid does not stagnate and the flows are stronger than the conventional ones, the contaminants removed from the cleaning target do not remain in the cleaning tank.

Further, in the above arangement, the cleaning tank has a substantially rectangular parallelopiped shape, and the complex and strong flows are generated in this cleaning tank. Therefore, unlike a conventional cleaning apparatus designed only for a cleaning target having a specific shape such as a silicon wafer, the cleaning apparatus of the present invention can be used for cleaning of a variety of cleaning targets including a cleaning target having a large size. Also, since the flows of the fluid are stronger than the conventional ones, the contaminants such as particles on the cleaning target removed by cleaning are immideately released out of the cleaning tank.

In order to achive the above-mentioned objects, another cleaning apparatus in accordance with the present inention is characterized by including:

a cleaning tank having a substantially rectangular parallelopiped shape with a region for storing a cleaning target with an incline;

a first inflow section for allowing a fluid to flow into the cleaning tank, the first inflow section provided on a position in a region on a first side surface of the cleaning tank in a vicinity of an upper end of the cleaning target inclined, the region corresponding to a distance between the upper end and a lower end of the cleaning target with respect to a bottom surface of the cleaning tank;

a second inflow section for allowing the fluid to flow into the cleaning tank, the second inflow section provided on a second side surface facing the first side surface on which the first inflow section is provided so that a height of the second inflow section from the bottom surface of the cleaning tank is in a vicinity of the lower end of the cleaning target inclined; and a plurality of outflow openings for releasing the fluid flowing in from the first inflow section and the second inflow section, the plurality of outflow openings provided on the first side surface and the second side surface so as to contact an upper surface of the cleaning tank, wherein at least one of the first inflow section and the second inflow section has a plurality of inflow openings whose heights from the bottom surface of the cleaning tank are different from one another.

With this arrangement, since the first inflow section and the second inflow section are provided on the side surfaces in the vicinity of the upper end and the lower end of the cleaning target, respectively, the fluid flows in in the vicinity directly beside the upper end and the lower end of the cleaning target placed by being inclined. As a result, more complex and stronger flows are formed on the cleaning target, thus improving the clenaing effect.

Further, since the cleaning target is inclined, the cleaning liquid can be removed with ease when taking the cleaning target out of the cleaning tank. Thus, even when the cleaning liquid contains particles, because the cleaning liquid is removed from the cleaning target almost completely, the particles do not remain on the cleaning target, thus further improving the cleaning effect for the cleaning target.

In the above cleaning apparatus, it is preferable that the first inflow section has a first inflow opening provided below a central portion of the cleaning target inclined and a second inflow opening provided above the central portion of the cleaning target, and the second inflow section has a third inflow opening provided on a position contacting the bottom surface of the cleaning tank and a fourth inflow opening provided on a substantially same level as the lower end of the cleaning target with respect to the bottom surface of the cleaning tank.

In this arangement, the first and second inflow openings of the first inflow section and the third and fourth inflow openings of the second inflow section are faced each other directly beside the cleaning target, and are positioned at different levels with respect to the bottom surface of the cleaning tank.

Therefore, the flows of the fluid do not cancel out and become more complex on the cleaning target, and as a result stagnation and weak flow of the fluid are effectively prevented. Also, by the third inflow opening, the stagnation and weak flow of the fluid, which are likely to occur in the vicinity of the bottom surface of the cleaning tank, are prevented effectively.

In order to achieve the above-mentioned objects, still another cleaning apparatus in accordance with the present invention is characterized by including:

a cleaning tank capable of storing a cleaning target;

an inflow opening, provided on a side surface of the cleaning tank, having a plurality of opening sections for allowing a fluid to flow into the cleaning tank; and an outflow opening for releasing the fluid flowing in from the inflow opening, wherein each of the plurality of opening sections has a shape selected from the group consisting of a circle with a diameter in a range of not less than 2 mm to not more than 5 mm and a rectangle with a side length in a range of not less than 2 mm to not more than 5 mm, or alternatively, from the group consisting of a circle with a diameter in a range of not less than 3 mm to not more than 4 mm and a rectangle with a side length in a range of not less than 3 mm to not more than 4 mm.

With this arrangement, the flows of the fluid are flown with a momentum and the particles (contaminants) on the cleaning target are removed effectively. As a result, the throughput in the cleaning process is improved. Further, since the opening sections are provided on predetermined positions in the cleaning tank, the particles are removed further effectively.

In the above cleaning apparatus, by setting the flow amount of the cleaning liquid flowing in from a single opening section in a range of 2.5 liters/min to 50 liters/min, the number of residual particles can be reduced effectivly. When the flow amount of the cleaning liquid is set in a range of 5 liters/min to 20 liters/min, the number of residual particles can be reduced further effectively.

For a fuller understanding of the nature and advantages of the invention, reference should be made to the ensuing detailed description taken in conjunction with the accompanying drawings.

BRIEF DESCRIPTION OF THE DRAWINGS

FIG. 6(*b*) is a drawing showing a particle concentration of a glass substrate when cleaned by the cleaning apparatus of FIG. 5.

FIG. 16(*b*) is a drawing showing a particle concentration of a glass substrate when cleaned by the cleaning apparatus of FIG. 9; and FIG. 16(*c*) is a drawing showing a particle concentration of a glass substrate when cleaned by the cleaning apparatus of FIG. 10.

FIG. 17(*b*) is a drawing showing a particle concentration of a glass substrate when cleaned by the cleaning apparatus of FIG. 14; and FIG. 17(*c*) is a drawing showing a particle concentration of a glass substrate when cleaned by the cleaning apparatus of FIG. 15.

DESCRIPTION OF THE EMBODIMENTS

[First Embodiment]

The following will describe one embodiment of the present invention referring to attached drawings. Note that the present invention is not limited by the following.

A cleaning method of the present embodiment is a method in which a fluid flows into a cleaning tank having a substantially rectangular parallelopiped shape from a first side surface of the cleaning tank and from a second side surface facing the first side surface towards a cleaning target stored in the cleaning tank, and the fluid flowing in from at least one of the first side surface and the second side surface is plural.

A cleaning apparatus of the present embodiment has an arrangement wherein a fluid flows into a cleaning tank from a first inflow section provided on a first side surface of the cleaning tank and from a second inflow section provided on a second side surface facing the first side surface, and at least one of the first inflow section and the second inflow section has a plurality of inflow openings which are provided at different levels with respect to a bottom surface of the cleaning tank.

Figure 1:
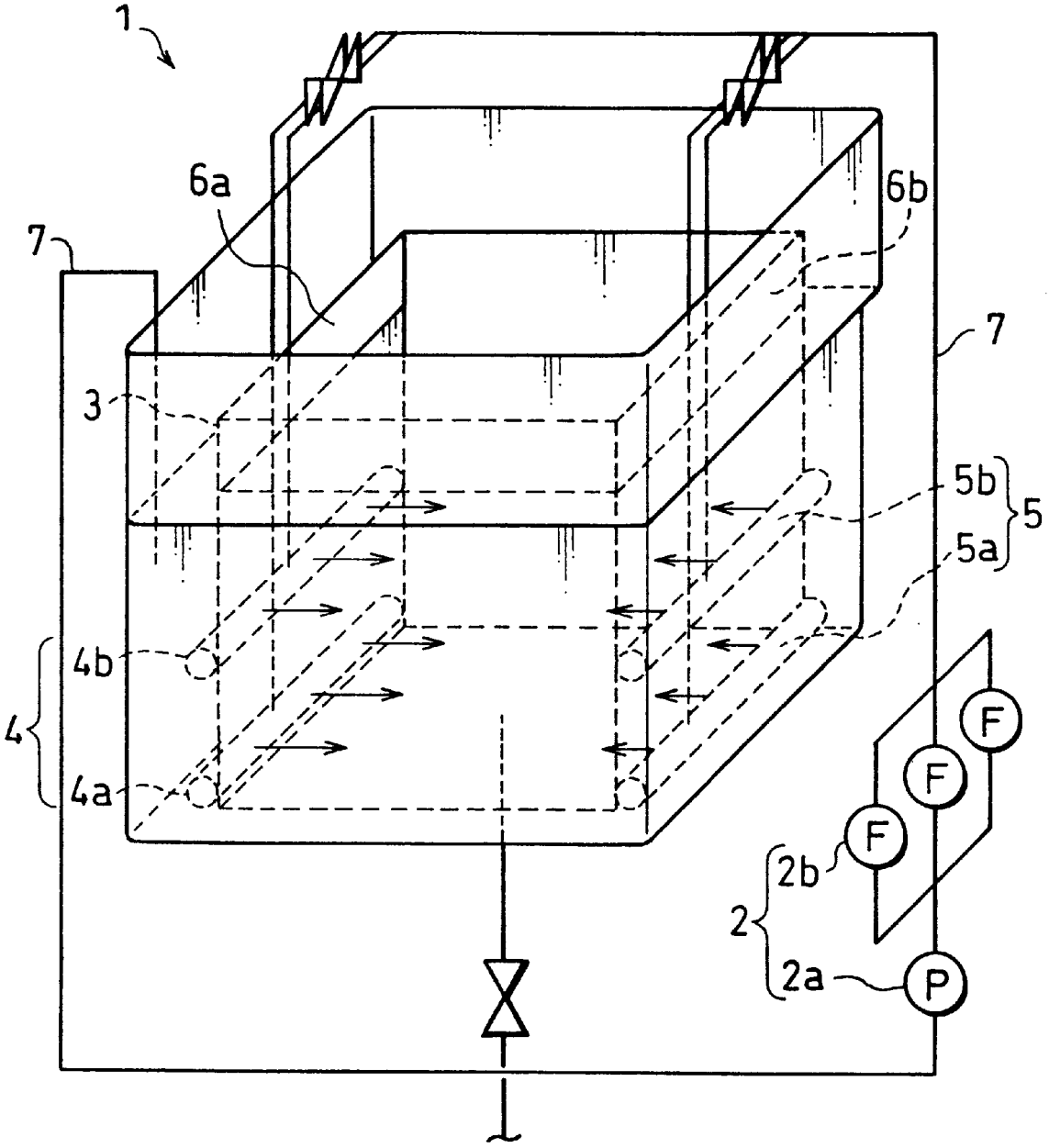
FIG. 1 is an explanatory drawing showing an arrangement of a cleaning apparatus which carries out cleaning by a cleaning method in accordance with one embodiment of the present invention.

Specifically, as shown in FIG. 1, a cleaning apparatus 1 of the present embodiment is provided with a circulatory section 2, a cleaning tank 3, a first inflow section 4, a second inflow section 5, two outflow openings 6*a* and 6*b*, and a pipe 7.

The circulatory section 2 is provided with a pump 2*a* and a filter 2*b*. The pump 2*a* forces a cleaning liquid (fluid) to the cleaning tank 3. The filter 2*b* removes contaminants such as particles contained in the cleaning liquid forced out from the pump 2*a*. The cleaning tank 3 has a substantially rectangular parallelopiped shape with a region capable of storing therein a plurality of large substrates used for liquid crystal display devices. The cleaning liquid forced out from the pump 2*a* and purified by the filter 2*b* flows into the cleaning tank 3 through inflow openings of the first inflow section 4 and the second inflow section 5 via the pipe 7.

Figure 2:
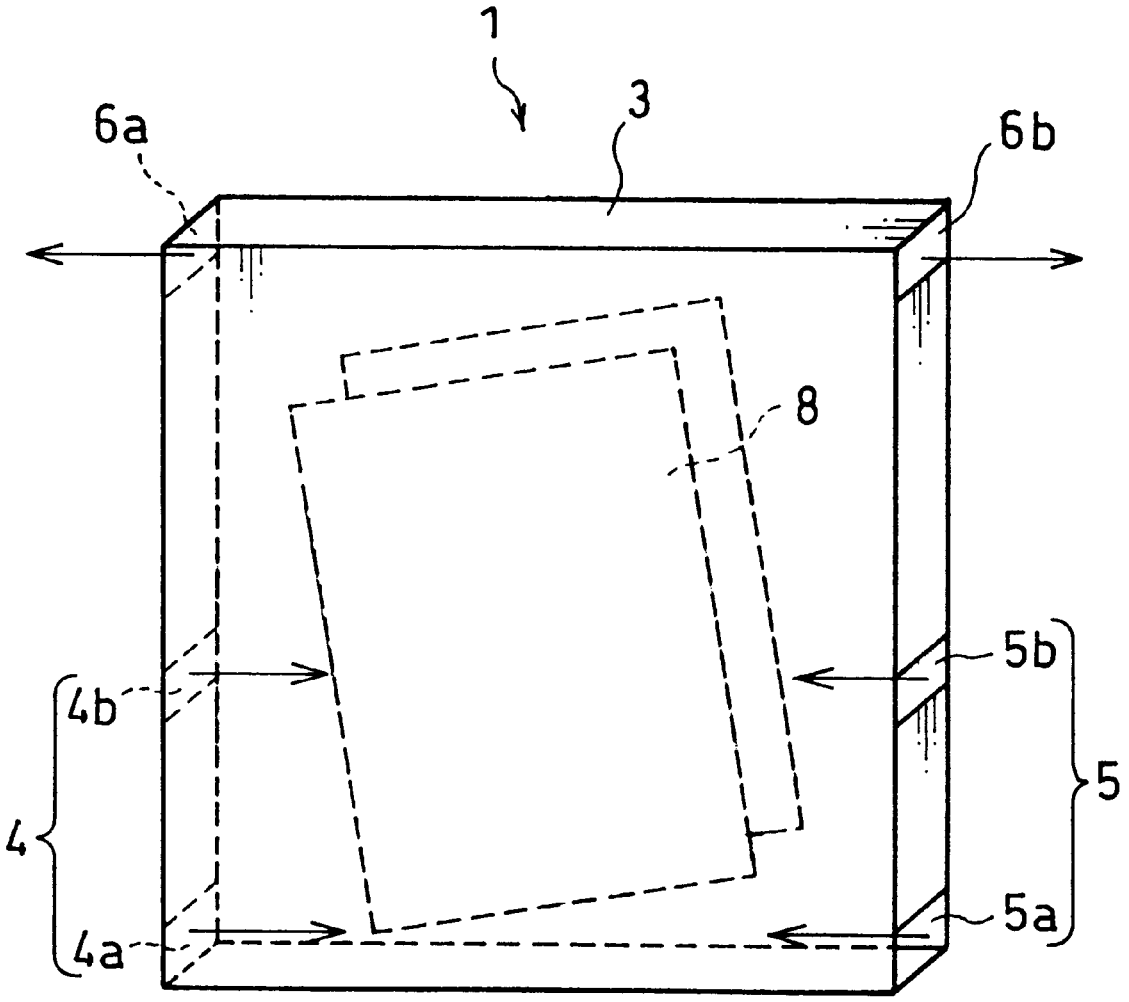
FIG. 2 is an explanatory drawing showing an arrangement of a cleaning tank of the cleaning apparatus of FIG. 1.

In the present embodiment, as shown in FIG. 1 and FIG. 2, the first inflow section 4 includes a first inflow opening 4*a* provided in the vicinity of the bottom surface of the cleaning tank 3 and a second inflow opening 4*b* provided above the first inflow opening 4*a* in the vertical direction, that is, on a position higher than where the first inflow opening 4*a* is provided with respect to the bottom surface of the cleaning tank 3. Note that, in the following, the height from the bottom surface of the cleaning tank 3 will be simply referred to as a height.

Similarly, in the present embodiment, the second inflow section 5 includes a third inflow opening 5*a* provided in the vicinity of the bottom surface of the cleaning tank 3 and a fourth inflow opening 5*b* provided on a position higher than the third inflow opening 5*a*. The inflow opening 5*a* is provided on the same level as the inflow opening 4*a* of the first inflow section 4, and the inflow opening 5*b* is provided on the same level as the inflow opening 4*b*. Also, as shown in FIG. 2, the inflow openings Sa and 5*b* of the second inflow section 5 are provided so as to face the inflow openings 4*a* and 4*b* of the first inflow section 4 via a region storing a cleaning target 8.

The outflow openings 6*a* and 6*b* for releasing the cleaning liquid out of the cleaning tank 3 are provided above the inflow openings 4*a* and 4*b* of the first inflow section 4 and the inflow openings 5*a* and 5*b* of the second inflow section 5. In the present embodiment, the outflow openings 6*a* and 6*b* are provided on upper end surfaces of the cleaning tank 3. The outflow opening 6*a* is provided above the first inflow section 4 in the vertical direction, and the outflow opening 6*b* is provided on a position facing the outflow opening 6*a*, that is, on a position above the second inflow section 5 in the vertical direction.

The cleaning liquid released out of the cleaning tank 3 returns to the pump 2*a* of the circulatory section 2 through the pipe 7 so as to be forced out again. The cleaning liquid forced out is immediately filtered by the filter 2*b*, and the contaminants in the cleaning liquid are removed, thus purifying the cleaning liquid. The cleaning liquid thus purified directly flows into the pipe 7 and again into the cleaning tank 3.

In the cleaning apparatus 1 having the described arrangement, because the cleaning liquid flows into the cleaning tank 3 through the first inflow section 4 including the inflow openings 4*a* and 4*b* and through the second inflow section 5 including the inflow openings 5*a* and 5*b*, where the first inflow section 4 and the second inflow section 5 are facing each other, a plurality of counter flows of the cleaning liquid are generated in the cleaning tank 3.

Specifically, as the cleaning liquid flows towards the cleaning target 8 from the inflow openings 4*a* and 4*b* of the first inflow section 4, two flows of the cleaning liquid flowing from the first side surface are generated in the cleaning tank 3. Similarly, as the cleaning liquid flows towards the cleaning target 8 from the inflow openings 5*a* and 5*b* of the second inflow section 5, two flows of the cleaning liquid flowing from the second side surface are generated in the cleaning tank 3. When such a plurality of counter flows are generated in the cleaning tank 3, the flows of the cleaning liquid are prevented from cancelling out each other, and more complex flows are generated.

Therefore, in the cleaning tank 3, the cleaning liquid is prevented from forming a simple large flow, and the flows of the cleaning liquid become stronger and more complex than the conventional ones. As a result, in the cleaning tank 3, it is possible to prevent stagnation of the cleaning liquid and generation of simple weak flows of the cleaning liquid forming a large swirl.

Thus, the particles adhering on a glass substrate (cleaning target 8) are removed with time substantially evenly and efficiently by the strong and complex flows without generating significant nonuniformity on the entire surfaces of the substrate 8. Further, since the flows of the cleaning liquid are stronger than the conventional ones, the particles removed by cleaning are immidiately released out of the cleaning tank 3 and the particles do not remain in the cleaning tank 3. Therefore, it is possible to prevent the cleaning target 8 from being contaminated again by residual particles in the cleaning tank 3.

Further, in the cirulatory section 2, the cleaning liquid released from the outflow openings 6*a* and 6*b* is filtered by the filter 2*b* so that the contaminants such as particles in the cleaning liquid are removed. Then, the cleaning liquid filtered and thus purified is flown into the cleaning tank 3 again by the pump 2*a*. Namely, because the circulatory section 2 functions as circulatory means, it is possible to use the cleaning liquid efficiently, and therefore a large amount of cleaning liquid is not required, thereby reducing the cost of cleaning.

In the present embodiment, the cleaning tank 3 has a size of 600 mm (width)×600 mm (depth)×600 mm (height). However, the size is not limited to this and as long as there is a sufficient room for the cleaning target 8 to be stored, any size can be adopted. Also, in the present embodiment, pure water is adopted as the cleaning liquid. However, not limiting to this, it is possible to mix a variety of drags or adopt other solvents in accordance with the type of the cleaning target 8 and the purpose of cleaning. Further, as long as a fluid is used for cleaning of the cleaning target 8, vapor or gas may be adopted instead of the cleaning liquid (liquid).

In the present embodiment, as the cleaning target 8, a large glass substrate used for liquid crystal display devices is adopted; however, not limiting to this, a variety of other objects may be cleaned. For example, the cleaning target 8 may be a small disc-shaped cleaning target such as a silicon wafer. In the present embodiment, as the large glass substrate, a substrate having a size of 400 mm×500 mm is adopted. Note that, in the following, explanations will be given through the case where the cleaning target 8 is the glass substrate 8.

When cleaning of the glass substrate 8 is finished, and after taking the glass substrate 8 out of the cleaning tank 3, it is required to remove as much amount of the cleaning liquid as possible from the glass substrate 8. This is because in the event where the residual cleaning liquid includes particles, when the cleaning liquid is removed from the the glass substrate 8 by drying, the particles remain on the glass substrate 8, and the glass substrate 8 is contaminated again.

For this problem, when the cleaning target is not a disc or sphere, specifically, when the cleaning target has a substantially rectangular parallelopiped shape as the glass substrate 8, it is preferable that the glass substrate 8 is placed in the cleaning tank 3 by being inclined with respect to the bottom surface of the cleaning tank 3. This allows the cleaning liquid to be directed towards the bottom-most apex of the glass substrate 8 when the glass substrate 8 is taken out of the cleaning liquid. As a result, the cleaning liquid is removed with ease, and residual particles are not generated on the glass substrate 8.

The glass substrate 8 is inclined by an angle preferably in a range of 10° to 30° with respect to the bottom surface of the cleaning tank 3. With an inclined angle in this range, the residual particles are prevented from generating, and it is not required to increase the size of the cleaning tank 3 more than required for the size of the cleaning target (glass substrate) 8.

Here, it is more than preferable that the cleaning tank 3 has a substantially rectangular parallelopiped shape. This prevents waste regions in the cleaning tank 3 when cleaning the large glass substrate 8. With the shape of the cleaning tank 3 other than the substantially rectangular parallelopiped shape, the effect of the present invention, that is to create strong and complex flows of the cleaning liquid without stagnation in the cleaning tank 3, may not be obtained.

In the cleaning apparatus 1 of the present embodiment, it is preferable that at least one of the plurality of inflow openings of the first inflow section 4 and the second inflow section 5 is provided on a position contacting the bottom surface of the cleaning tank 3. Namely, in the present cleaning method, it is preferable that at least one of the flows of the cleaning liquid from the first inflow section 4 and the second inflow section 5 is from a position contacting the bottom surface of the cleaning tank 3.

For example, as shown in FIG. 2, the lower inflow opening 4*a* of the first inflow section 4 and the lower inflow opening 5*a* of the second inflow opening 5 are both positioned so as to contact the bottom surface of the cleaning tank 3, and the cleaning liquid flowing from the inflow openings 4*a* and 5*a* generates flows in the cleaning tank 3. Note that, it is possible that only one of the inflow openings 4*a* and 5*a* is provided on a position contacting the bottom surface of the cleaning tank 3.

Also, in the arrangement of the inflow openings of the first inflow section 4 and the second inflow section 5, the positioning of the inflow openings (inflow openings 4*b* and 5*b*) other than the inflow openings (inflow openings 4*a* and 5*a*) provided so as to contact the bottom surface of the cleaning tank 3 is not particularly limited. In the cleaning apparatus 1 in accordance with the present invention, the inflow openings 4*b* and 5*b* are provided on such positions that in the cleaning apparatus 3, the cleaning liquid flows in without resulting in, at least, cancellelation of flows and generation of stagnation. In the cleaning apparatus 1 as shown in FIG. 1 and FIG. 2, the inflow openings 4*b* and 5*b* are provided so that the height of respective centers of the openings is 260 mm from the bottom surface of the cleaning tank 3.

Supposing that the cleaning apparatus 1 is provided only with a single inflow opening for each of the first inflow section 4 and the second inflow section 5, then in the cleaning tank 3, a simple large flow is likely to be generated, and the cleaning liquid stagnates more often in a region outside this flow. Further, such a large flow transforms itself into a weak flow by forming a swirl, and as a result the glass substrate 8 cannot be cleaned effectively.

Also, when at least one of the inflow openings of the first inflow section 4 and the second inflow section 5 is not provided on a position contacting the bottom surface of the cleaning tank 3, that is, when there is no flow of the cleaning liquid from a position contacting the bottom surface of the cleaning tank 3, stagnation of the cleaning liquid is more likely to be generated in the vicinity of the bottom surface of the cleaning tank 3, and therefore this arrangement is not preferable.

Namely, in the cleaning apparatus 1 of the present embodiment, at least, at least one of the first inflow section 4 and the second inflow section 5 is provided with a plurality of inflow openings which are provided at different levels with respect to the bottom surface of the cleaning tank 3. Preferably, at least one of the plurality of inflow openings of the first inflow section 4 and the second inflow section 5 is provided on a position adjacent to the bottom surface of the cleaning tank 3.

In other words, in the cleaning method of the present embodiment, a plurality of flows of the cleaning liquid (fluid) from the first side surface and a plurality of flows of the cleaning liquid from the second side surface flow into the cleaning tank 3 at different levels, and preferably, at least one of the flows is from a position contacting the bottom surface of the cleaning tank 3.

Figure 3:
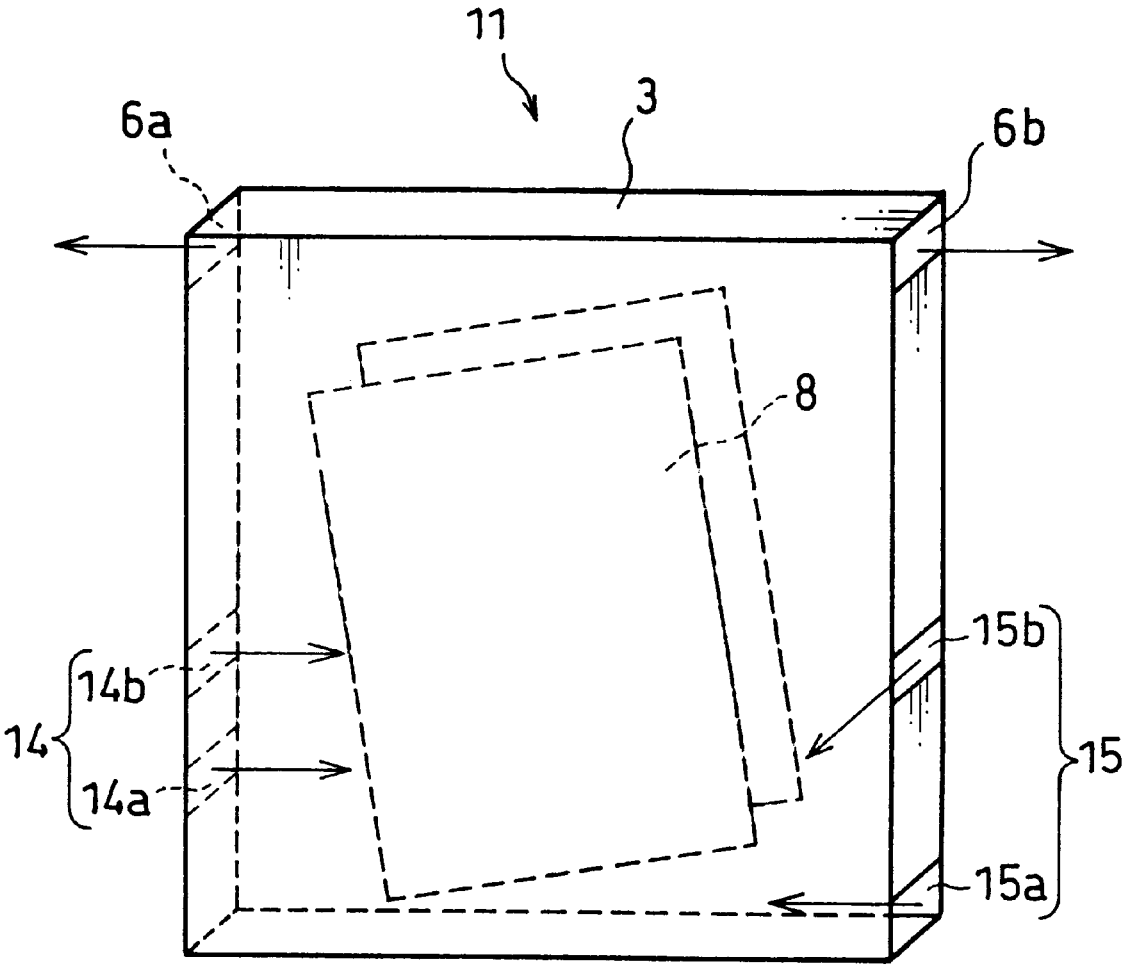
FIG. 3 is an explanatory drawing showing another arrangement of the cleaning tank of the cleaning apparatus of FIG. 1.

Thus, in the present embodiment, as another example of the cleaning apparatus 1, as shown in FIG. 3, it is possible to adopt a cleaning apparatus 11 in which the distance in height between two inflow openings 14*a* and 14*b* of a first inflow section 14 is shorter than the distance between the inflow openings 4*a* and 4*b* of the first inflow section 4 of the cleaning apparatus 1. In the cleaning apparatus 11, the arrangement of the cleaning tank 3, the outflow openings 6*a* and 6*b*, and other members is the same as that of the cleaning apparatus 1 except the arrangement of the first inflow section 14 and the second inflow section 15.

In the cleaning apparatus 11, as with the inflow opening 5*a* of the cleaning apparatus 1, while the inflow angles of the cleaning liquid at the inflow openings 14*a* and 14*b* and the inflow angle of the cleaning liquid at the inflow opening 15*a* of the second inflow section 15 are substantially perpendicular to the side surfaces on which the inflow openings are formed, the inflow angle of the cleaning liquid at the upper inflow opening 15*b* of the second inflow section 15 is inclined downward with respect to the side surface.

As in the cleaning apparatus 11, when the inflow angles of the inflow openings 14*a* and 14*b* of the first inflow section 14 and the inflow angle of the inflow opening 15*b* of the second inflow section 15 are different, the flowing directions of the cleaning liquid from the first side surface and the second side surface are also different in the cleaning tank 3. As a result, compared with the cleaning apparatus 1, the cleaning liquid forms more complex and stronger flows in the cleaning tank 3. It is further preferable that the inflow angle of the inflow opening 15*a* is also different from the inflow angles of the inflow openings 14*a* and 14*b* of the first inflow section 14.

Namely, by appropriately changing the inflow angles of the cleaning liquid at the inflow openings, in the cleaning tank 3, the flows of the cleaning liquid become more complex, thus effectively preventing further the stagnation of the cleaning liquid and generation of weak flows of the cleaning liquid. Note that, the range of inflow angles and the optimum inflow angle are changed appropriately depending on positioning of the inflow openings. For example, it is preferable that the inflow angle of the inflow opening 15*b* is in a range of 35° to 55°, more preferably in a range of 40° to 50°. However, the inflow angle in this range cannot be applied unconditionally to the other inflow openings 14*a*, 14*b*, and 15*a*.

In the cleaning apparatuses 1 and 11, the shape of the inflow openings of the first inflow sections 4 and 14 and of the inflow openings of the second inflow sections 5 and 15 is not particularly limited as long as they are not large flat inflow openings formed on the side surfaces of the cleaning tank 3. In the cleaning apparatuses 1 and 11 of the present embodiment, the inflow opening adopts a nozzle having five circular openings each having a diameter in a range of 3 mm to 4 mm.

In this manner, when a nozzle having a plurality of small openings is adopted as the inflow opening, the flow amount of the cleaning liquid into the cleaning tank 3 is increased, and strong flows of the cleaning liquid are generated in the cleaning tank 3, thus cleaning the glass substrate 8 further effectively.

Here, the nozzles adopted as the inflow openings of the first inflow section (inflow openings 4*a* and 4*b* in the cleaning apparatus 1, and inflow openings 14*a* and 14*b* in the cleaning apparatus 11) and the nozzles adopted as the inflow openings of the second inflow section (inflow openings 5*a* and 5*b* in the cleaning apparatus 1, and inflow openings 15*a* and 15*b* in the cleaning apparatus 11) have substantially the same shape. Thus, the kinetic energy of the cleaning liquid flowing in from each inflow opening is substantially the same.

In the cleaning tank 3, the first inflow section 4 or 14 and the second inflow section 5 or 15 are positioned so as to sandwich the glass substrate 8. Therefore, the kinetic energy of the flows of the cleaning liquid flowing in from the side surfaces are substantially the same with respect to the glass substrate 8, thus further preventing stagnation of the cleaning liquid in the cleaning tank 3.

Note that, the inflow openings may be openings provided on the side surfaces of the cleaning tank 3, or may be slits or openings formed on pipes provided in the cleaning tank 3.

Also, in the present embodiment, it is preferable that the inflow amount of the cleaning liquid from each inflow opening is in a range of 50 liters/min to 200 liters/min, more preferably substantially 100 liters/min. The inflow amount of the cleaning liquid in this range is preferable because it allows the cleaning liquid to flow into the cleaning tank 3 uniformly without stagnation and prevents swirling of the cleaning liquid, thus generating complex and strong cleaning liquid flows. As a result, it is possible to quickly and evenly remove the particles adhering on the surfaces of the glass substrate 8.

In the cleaning apparatuses 1 and 11, the two outflow openings 6*a* and 6*b* for releasing the cleaning liquid out of the cleaning tank 3 are provided on positions contacting the upper end surfaces of the cleaning tank 3, which are higher than the first inflow sections 4 and 14 and the second inflow sections 5 and 15 with respect to the bottom surface of the cleaning tank 3. The outflow openings 6*a* and 6*b* are provided above the first inflow sections 4 and 14 and the second inflow sections 5 and 15, respectively. The outflow openings 6*a* and 6*b* are provided as outflow openings of the overflow system in which the cleaning liquid is uniformly released from the upper surface of the cleaning tank 3.

When the outflow openings 6*a* and 6*b* are provided in the described manner, the cleaning liquid flown into the cleaning tank 3 flows from the lower portion up towards the upper portion of the cleaning tank 3, where the outflow openings 6*a* and 6*b* are provided. Namely, the cleaning liquid is released out of the cleaning tank 3 after cleaning the glass substrate 8 from a position higher than a position from which the cleaning liquid flows in with respect to the bottom surface of the cleaning tank 3. However, because the cleaning liquid tends to flow downward towards the lower portion of the cleaning tank by the force of gravity, the flows of the cleaning liquid become more complex. Further, since two outflow openings 6*a* and 6*b* are provided, compared with the case where only one outflow opening is provided, the flows of the cleaning liquid become even more complex. As a result, it is possible to prevent further effectively the stagnation of the cleaning liquid and generation of weak flows of the cleaning liquid in the cleaning tank 3.

Note that, the positioning of the outflow openings 6*a* and 6*b* is not particularly limited as long as they are provided, as described above, on positions higher than the first inflow section 4 and the second inflow section 5, that is, positions higher than where the cleaning liquid flows in. Also, although it is preferable that the outflow openings 6*a* and 6*b* are provided one by one on the side surfaces (first side surface and second side surface) on which the first inflow section 4 and the second inflow section 5 are provided, respectively, not limiting to this, more than one outflow openings 6*a* and 6*b* may be provided.

Note that, in the cleaning apparatuses (cleaning apparatuses 1 and 11) described in the present embodiment, each of the first inflow section and the second inflow section is provided with two inflow openings. However, not limiting to this, the cleaning apparatus in accordance with the present invention may have an arrangement wherein at least one of the first inflow section and the second inflow section is provided with three or more inflow openings. Also, when two or more outflow openings are provided, the stagnation of the fluid (cleaning liquid) in the cleaning tank is prevented further effectively.

[Second Embodiment]

The following will describe another embodiment of the present invention referring to attached drawings. Note that, members having the same functions as the members described in First Embodiment are given the same reference numerals and explanations thereof are omitted here. Also, the present invention is not limited by the present embodiment.

A cleaning method of the present embodiment is a method in which a fluid flows in from one of the side surfaces directly towards a side of a cleaning target stored in a cleaning tank by being inclined, and the fluid also flows in from the other side surface on a position in the vicinity of the lower end of the cleaning target, and the fluid flowing in from at least one of the side surfaces is plural.

Namely, a cleaning apparatus of the present embodiment has the same arrangement as the cleaning apparatuses 1 and 11 of First Embodiment except the arrangement that the range of the height of the two inflow openings of the first inflow section is limited, and that an upper inflow opening of the two inflow openings of the second inflow section is positioned differently.

Figure 4:
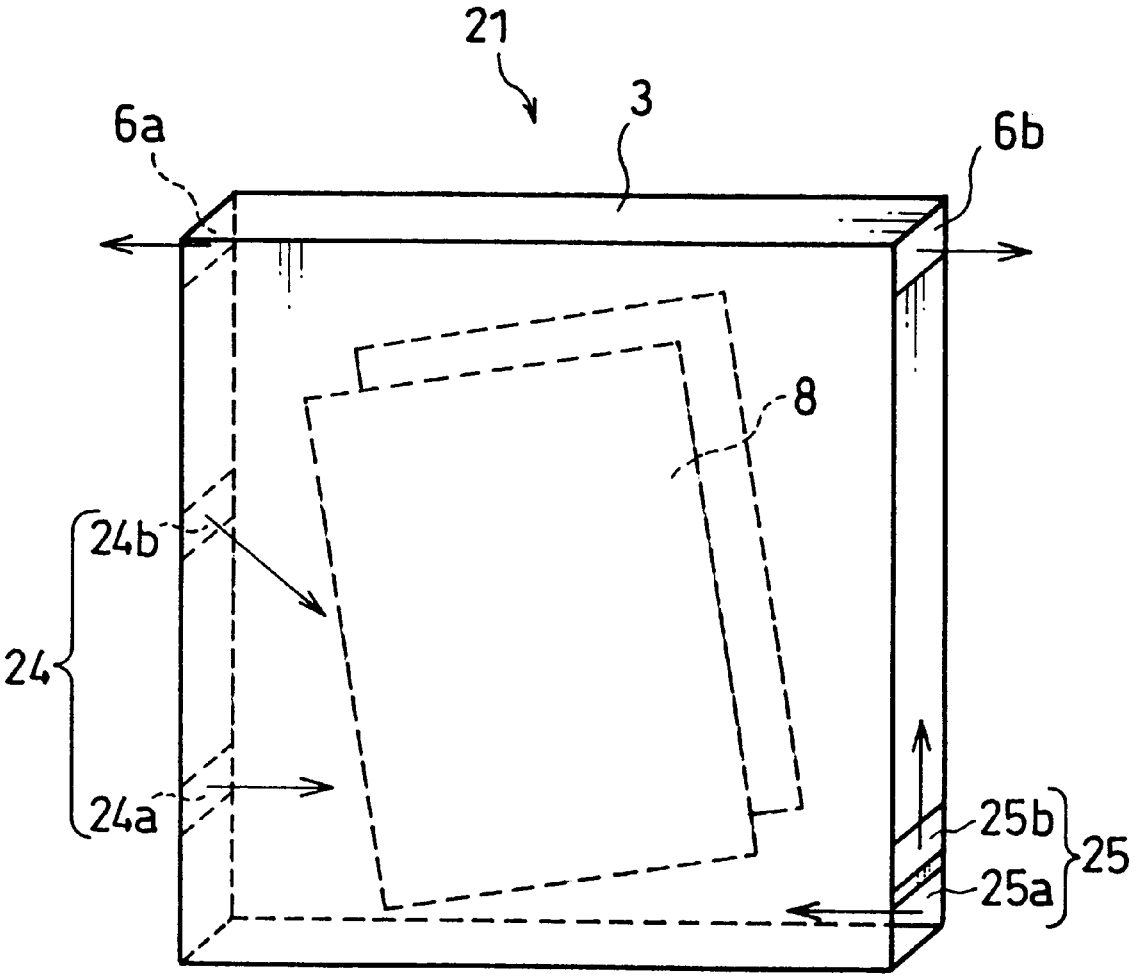
FIG. 4 is an explanatory drawing showing an arrangement of a cleaning tank of a cleaning apparatus which carries out cleaning by a cleaning method in accordance with another embodiment of the present invention.

As shown in FIG. 4, a cleaning apparatus 21 of the present embodiment is provided with a circulatory section and a pipe (both not shown), the cleaning tank 3, a first inflow section 24, a second inflow section 25, and the outflow openings 6*a* and 6*b*. In the cleaning apparatus 21, after the glass substrate 8 (cleaning target) is cleaned in the cleaning tank 3, the cleaning liquid is released out of the cleaning tank 3 from the outflow openings 6*a* and 6*b*. The cleaning liquid thus released is then flown into the cleaning tank 3 again by being filtered by the circulatory section (not shown), as in the cleaning apparatus 1 of First Embodiment.

The first inflow section 24 is provided on a first side surface in the vicinity of the upper end side of the glass substrate 8 which is a cleaning target placed in the cleaning tank 3 having a substantially rectangular parallelopiped shape. The second inflow section 25 is provided on a second side surface in the vicinity of the lower end side of the inclined glass substrate 8. The first side surface and the second side surface are facing each other as in First Embodiment.

The first inflow section 24 is provided in a region corresponding to the distance between the upper end and the lower end of the glass substrate 8 with respect to the bottom surface of the cleaning tank 3, and has two inflow openings 24*a* and 24*b*. The second inflow section 25 is provided on such a position that the height from the bottom surface of the cleaning tank 3 is in the vicinity of the lower end of the inclined glass substrate 8, and has two inflow openings 25*a* and 25*b*. Above the first inflow section 24 and the second inflow section 25, that is, on portions of the first side surface and the second side surface contacting the upper surface of the cleaning tank 3, there are provided the outflow openings 6*a* and 6*b* for releasing the cleaning liquid, as in the cleaning apparatuses 1 and 11 of First Embodiment.

As long as the first inflow opening 24*a* and the second inflow opening 24*b* of the first inflow section 24 are provided between a region corresponding to the distance between the upper end and the lower end of the inclined glass substrate 8, their positions are not particularly limited. Nevertheless, it is preferable that the first inflow opening 24*a* is positioned below the center of the inclined glass substrate 8, and the second inflow opening 24*b* is positioned above the center of the inclined glass substrate 8.

Similarly, as long as the third inflow opening 25*a* and the fourth inflow opening 25*b* of the second inflow section 25 are provided between a region corresponding to the distance between the upper end and the lower end of the inclined glass substrate 8, their positions are not particularly limited. However, it is preferable that the third inflow opening 25*a* is positioned so as to contact the bottom surface of the cleaning tank 3, and that the fourth inflow opening 25*b* is positioned so as to be substantially at the same level as the lower end of the glass substrate 8 with respect to the bottom surface of the cleaning tank 3.

Namely, in the cleaning method of the present embodiment, the cleaning liquid flowing in from the first side surface has two flows respectively flowing from the inflow openings 24*a* and 24*b*, and the cleaning liquid flowing in from the second side surface has two flows respectively flowing from the inflow openings 25*a* and 25*b*. Note that, in the following, the flow of the cleaning liquid from the first inflow opening 24*a* will be referred to as a first flow, and the flow of the cleaning liquid from the second inflow opening 24*b* will be referred to as a second flow. Likewise, the flow of the cleaning liquid from the third inflow opening 25*a* will be referred to as a third flow, and the flow of the cleaning liquid from the fourth inflow opening 25*b* will be referred to as a fourth flow.

In the present embodiment, the cleaning tank 3 has a size of 600 mm (width)×600 mm (depth)×600 mm (height). Also, as in First Embodiment, it is preferable that the glass substrate 8 is inclined by an angle in a range of 10° to 30° with respect to the bottom surface of the cleaning tank 3.

In the present embodiment, the first inflow opening 24*a* of the first inflow section 24 on the first side surface is positioned with a height of 90 mm from the bottom surface of the cleaning tank 3, and the second inflow opening 24*b* of the first inflow section 24 on the first side surface is positioned with a height of 370 mm from the bottom surface of the cleaning tank 3. The third inflow opening 25*a* of the second inflow section 25 on the second side surface is positioned adjacent to the bottom surface of the cleaning tank 3, and the fourth inflow opening 25*b* of the second inflow section 25 on the second side surface is positioned with a height of 50 mm from the bottom surface of the cleaning tank 3.

As in First Embodiment, the shapes of the inflow openings 24*a* and 24*b* of the first inflow section 24 and of the inflow openings 25*a* and 25*b* of the second inflow section 25 are not particularly limited as long as they are not large flat inflow openings formed on the side surfaces of the cleaning tank 3. In the present embodiment, as in First Embodiment, a nozzle having five circular openings each having a diameter in a range of 3 mm to 5 mm is adopted. When such a nozzle is adopted as the inflow opening, the flow amount of the cleaning liquid into the cleaning tank 3 is increased, and strong flows of the cleaning liquid are generated, thus cleaning the glass substrate 8 further effectively.

Here, the nozzles adopted as the inflow openings 24*a* and 24*b* of the first inflow section 24 and the nozzles adopted as the inflow openings 25*a* and 25*b* of the second inflow section 25 have substantially the same shape. Therefore, the kinetic energy of the cleaning liquid flowing in from each inflow opening is substantially the same, and the flows of the cleaning liquid flowing in from the side surfaces of the cleaning tank 3 as in First Embodiment have substantially the same kinetic energy, thus further preventing stagnation of the cleaning liquid in the cleaning tank 3.

Note that, the inflow openings may be openings provided on the side surfaces of the cleaning tank 3, or may be slits or openings formed with respect to pipes provided in the cleaning tank 3.

As described, when the first inflow section 24 is provided between a region corresponding to the distance between the upper end and the lower end of the inclined glass substrate 8, and when the second inflow section 25 in provided in the vicinity of the lower end of the inclined glass substrate 8, the first inflow section 24 and the second inflow section 25 are directly beside the glass substrate 8. Therefore, the flows (first and second flows) of the cleaning liquid flowing directly towards the sides of the glass substrate 8 become stronger and more complex on the glass substrate 8.

Further, when the first inflow opening 24*a* and the second inflow opening 24*b* of the first inflow section 24 and the third inflow opening 25*a* and the fourth inflow opening 25*b* of the second inflow section 25 are faced each other directly beside the glass substrate 8 as described above, and are positioned at different levels with respect to the bottom surface of the cleaning tank 3, on the glass substrate 8, the flows (first through fourth flows) of the cleaning liquid from the inflow openings do not cancel out each other and become more complex. As a result, it is possible to effectively prevent stagnation of the cleaning liquid and generation of weak flows. Also, by the third inflow opening 25*a*, the stagnation and weak flow of the cleaning liquid, which tend to occur in the vicinity of the bottom surface of the cleaning tank 3, are prevented effectively.

Further, since the glass substrate 8 is inclined, the cleaning liquid can be removed with ease when taking the glass substrate 8 out of the cleaning tank 3. Thus, even when the cleaning liquid contains particles, since most of the particles are removed from the glass substrate 8, the particles do not remain on the surfaces of the glass substrate 8, thus further improving the cleaning effect for the glass substrate 8.

Furthermore, in the cleaning apparatus 21 of the present embodiment, the cleaning liquid flows in from the inflow opening 24*a* in a direction substantially parallel to the bottom surface of the cleaning tank 3, and from the inflow opening 24*b* in a direction inclined downward towards the bottom surface of the cleaning tank 3. Also, the cleaning liquid flows in from the inflow opening 25*a* in a direction substantially parallel to the bottom surface of the cleaning tank 3, and from the inflow opening 25*b* in a direction substantially parallel to the second side surface. Namely, in the cleaning apparatus 21 of the present embodiment, in the first inflow section 24 and the second inflow section 25 facing each other, the inflow openings are provided at different levels, and the inflow angles of the cleaning liquid are also different.

Namely, in the cleaning method of the present embodiment, the first flow of the cleaning liquid flows in a direction substantially parallel to the bottom surface of the cleaning tank 3, and the second flow flows in a direction inclined downward towards the bottom surface of the cleaning tank 3, and the third flow flows in a direction substantially parallel to the bottom surface of the cleaning tank 3, and the fourth flow flows in a direction substantially parallel to the second side surface.

When the inflow openings are provided in the described arrangement, by the second flow flowing from the inflow opening 24*b* in a direction inclined downward, two flows of (a) the first flow from the inflow opening 24*a* for cleaning the glass substrate 8 (cleaning target) from directly beside it and (b) the second flow for cleaning the glass substrate 8 in an inclined direction from above are formed. Also, since the inflow openings 24*a* and 24*b* of the first inflow section 24 and the inflow openings 25*a* and 25*b* of the second inflow section 25 are positioned at different levels, the first and second flows are not cancelled by the third and fourth flows.

As a result, the four flows of the cleaning liquid in the cleaning tank 3 do not cancel out each other and become more complex. This effectively prevents stagnation and weak flow of the cleaning liquid, thus improving the cleaning efficiency for the glass substrate 8.

Further, since the two inflow openings 24*a* and 24*b* of the first inflow section 24 are provided directly beside the glass substrate 8, the cleaning liquid forms stronger and more complex flows on the glass substrate 8, thus further improving the cleaning effect for the glass substrate 8.

Furthermore, the third inflow opening 25*a* is provided on the same level as the lower end of the glass substrate 8. That is, the inflow opening 25*a* is provided on a position contacting the bottom surface of the cleaning tank 3. Thus, by the third flow from the inflow opening 25*a*, it is possible to effectively prevent stagnation of the cleaning liquid, which is likely to occur in the vicinity of the bottom surface of the cleaning tank 3, and weak flow of the cleaning liquid.

Also, as in First Embodiment, the outflow openings 6*a* and 6*b* for releasing the cleaning liquid out of the cleaning tank 3 are provided on positions contacting the upper surface of the cleaning tank 3, that is, on positions higher than the first inflow section 24 and the second inflow section 25 with respect to the bottom surface of the cleaning tank 3, and the shape of the outflow openings 6*a* and 6*b* is also the same as that of the outflow openings 6*a* and 6*b* of First Embodiment. Therefore, in the cleaning tank 3, the flows of the cleaning liquid become more complex and it is possible to prevent further effectively the stagnation and weak flow of the cleaning liquid.

As the range of the inflow angle of the cleaning liquid at the second inflow opening 24*b*, with respect to the first side surface, a range of 30° to 60° is preferable, and a range of 40° to 50° is more preferable. The inflow angle of the cleaning liquid at the inflow opening 24*b* outside these ranges results in stagnation and weak flow of the cleaning liquid on the glass substrate 8 and therefore is not preferable. As the inflow angle of the cleaning liquid at the fourth inflow opening 25*b*, an inflow angle of not more than 10°, or more preferably not more than 5° is preferable with respect to the second side surface. The inflow angle of the cleaning liquid at the inflow opening 25*b* other than these angles tends to cause stagnation of the cleaning liquid in the upper portion of the cleaning tank 3 and therefore is not preferable.

Also, as in First Embodiment, the flow amount of the cleaning liquid from each inflow opening is preferably in a range of 50 liters/min to 200 liters/min, more preferably around 100 liters/min. The inflow amount of the cleaning liquid in this range is preferable because it allows the cleaning liquid to flow into the cleaning tank 3 uniformly without causing stagnation and prevents a simple large flow of the cleaning liquid forming a swirl. As a result, it is possible to quickly and evenly remove the particles adhering on the surfaces of the glass substrate 8.

Figure 5:
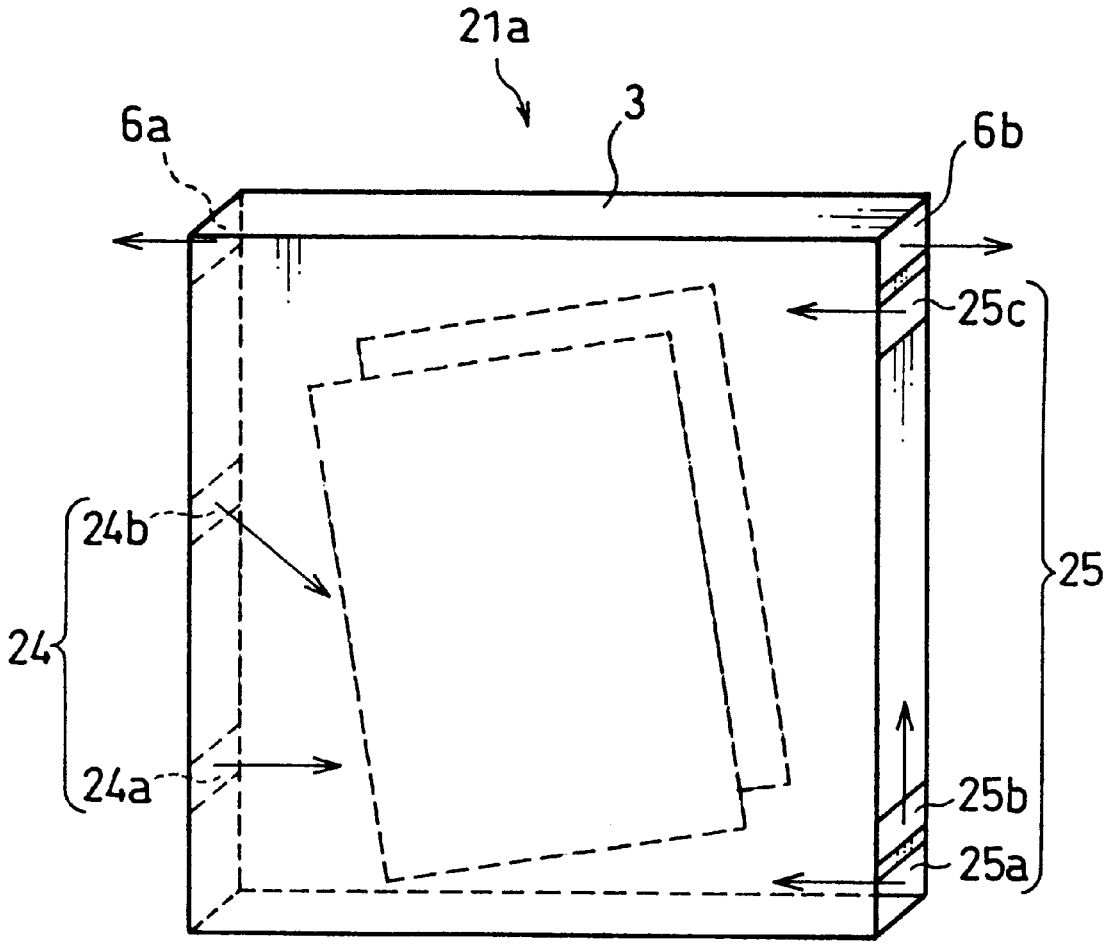
FIG. 5 is an explanatory drawing showing another arrangement of the cleaning tank of the cleaning apparatus of FIG. 4.

As the cleaning apparatus of the present embodiment, as shown in FIG. 5, a cleaning apparatus 21*a* having a fifth inflow opening 25*c* in addition to the described arrangement may be adopted. Namely, the flow of the cleaning liquid from the second side surface may include an additional flow in addition to the third and fourth flows. Note that, the flow of the cleaning liquid from the fifth inflow opening 25*c* will be referred to as a fifth flow.

The fifth inflow opening 25*c* is provided in the vicinity of the outflow opening 6*b* provided above the two inflow openings 25*a* and 25*b* of the second inflow section 25. Specifically, the inflow opening 25*c* is provided on a position 16 mm below the lower end of the outflow opening 6*b* of the cleaning apparatus 21*a*.

When the fifth inflow opening 25*c* is positioned as above, by the fifth flow from the inflow opening 25*c*, the contaminants such as particles removed from the glass substrate 8, which tend to remain in the vicinity of the fluid surface in the upper portion of the cleaning tank 3, can be removed effectively. Therefore, it is possible to prevent re-contamination of the glass substrate 8, as caused by residual particles, which occurs when taking the glass substrate 8 out of the cleaning tank 3 after cleaning. Also, by the fifth flow, stagnation and weak flow of the cleaning liquid are effectively prevented from generating in the upper portion of the glass substrate 8 placed in the cleaning tank 3.

It is preferable that the inflow amount of the cleaning liquid from the inflow opening 25*c* is less than the inflow amount from any of the other inflow openings. In other words, the fifth flow is preferably smaller than any of the first through fourth flows in the cleaning tank 3. Specifically, it is preferable that the inflow amount from the inflow opening 25*c* is in a range of 3 liters/min to 10 liters/min, more preferably substantially 5 liters/min.

When the inflow amount of the cleaning liquid from the fifth inflow opening 25*c* is in this range, the flow of the cleaning liquid from the inflow opening 25*c* is slightly weaker than any other flow of the cleaning liquid from the other inflow openings. This allows the contaminants such as particles removed from the glass substrate 8, which tend to remain in the vicinity of the fluid surface in the upper portion of the cleaning tank 3, to be effectively removed without disturbing the flows of the cleaning liquid from the other inflow openings. Also, because the surfaces of the glass substrate 8 are further cleaned when taking the glass substrate 8 out of the cleaning tank 3, re-contamination by the particles is prevented.

When the inflow amount of the cleaning liquid from the inflow opening 25*c* is outside the above range, the flow of the cleaning liquid from the inflow opening 25*c* disturbs the flows of the cleaning liquid from the other inflow openings. The disturbance in the flows of the cleaning liquid caused in this manner may weaken the flows of the cleaning liquid as the flows of the cleaning liquid are cancelled out. There is also a case where the particles, which tend to remain in the upper portion of the cleaning liquid in the cleaning tank 3, cannot be removed, and as a result re-contamination by the residual particles occurs when taking the glass substrate out of the cleaning tank 3.

Note that, in the cleaning apparatuses (cleaning apparatuses 21 and 21*a*) described in the present embodiment, as described above, the first inflow section and the second inflow section each has two or three inflow openings. Nevertheless, the arrangement of the cleaning apparatus in accordance with the present invention is not limited to the described arrangement, and it is possible to have an arrangement wherein the first inflow section and the second inflow section each has more than three inflow openings.

[Third Embodiment]

The following will describe yet another embodiment of the present invention referring to attached drawings. Note that, members having the same functions as the members described in First and Second Embodiment are given the same reference numerals and explanations thereof are omitted here. Also, the present invention is not limited by the following.

In a cleaning apparatus of the present embodiment, in order to improve the cleaning effect of the cleaning methods and the cleaning apparatuses of First and Second Embodiment, the shape of inflow openings and the inflow amount of the cleaning liquid are specified.

Specifically, for example, each of the inflow openings 4*a*, 4*b*, 5*a*, and 5*b* provided on the side surfaces of the cleaning tank 3 of the cleaning apparatus 1 (see FIG. 1 and FIG. 2) described in First Embodiment has a plurality of opening sections each having a circular shape with a diameter of not less than 2 mm to not more than 5 mm, or a rectangular shape with a side of not more than 2 mm to not less than 5 mm.

The way the plurality of opening sections are positioned on the side surfaces of the cleaning tank 3 is not particularly limited so that it is possible, for example, to suitably adopt an arrangement wherein a nozzle having the plurality of opening sections is provided on the side surfaces of the cleaning tank 3. Namely, each of the inflow openings 4*a*, 4*b*, 5*a*, and 5*b* is provided as a nozzle having the plurality of opening sections on the side surfaces of the cleaning tank 3. As another way of providing the plurality of opening sections on the sides of the cleaning tank 3, it is possible to suitably adopt an arrangement wherein the plurality of opening sections are provided on pipes placed in the cleaning tank 3.

It is preferable that the diameter of the circle or the side length of the rectangle of the opening section is in a range of 2 mm to 5 mm, more preferably in a range of 3 mm to 4 mm. When the diameter or the side length is less than 2 mm or exceeds 5 mm, strong and complex flows cannot be formed effectively in the cleaning tank 3. Also, although the shape of the opening sections is not particularly limited, a circle (round shape) or rectangle (square shape) is preferable because it reduces the amount of residual particles.

From each inflow opening having the plurality of opening sections, the cleaning liquid is injected in a direction perpendicular to the substrate. Also, it is preferable that the inflow amount from each of the opening sections of the inflow openings is in a range of 2.5 liters/min to 50 liters/min, more preferably in a range of 5 liters/min to 20 liters/min.

When the inflow amount from each opening section is in the above ranges, the cleaning liquid flows uniformly into the cleaning tank 3, preventing stagnation and a simple large flow of the cleaning liquid forming a swirl. As a result, it is possible to quickly and evenly remove the particles adhering on the surfaces of the cleaning target such as the glass substrates 8.

When the inflow amount is less than 2.5 liters/min or exceeds 50 liters/min, strong and complex flows cannot be formed effectively in the cleaning apparatus 1.

The number of opening sections per one inflow opening is not particularly limited. For example, in the present embodiment, when a nozzle is adopted as the inflow opening as in First and Second Embodiment, a nozzle having five opening sections or a nozzle having 10 opening sections may be suitably adopted.

Therefore, the inflow amount of the cleaning liquid flowing from a single inflow opening is the amount which is the product of the inflow amount from one opening section and the number of opening sections of the single inflow opening. For example, when a single inflow opening is a nozzle having 10 opening sections, the inflow amount of the cleaning liquid from this inflow opening is in a range of 25 liters/min to 500 liters/min, more preferably in a range of 50 liters/min to 200 liters/min.

Note that, the range of the size of the opening section and the range of the inflow amount from the opening section are determined from the results of measurements in Examples 3 and 4 which will be described later.

By cleaning the glass substrates using the cleaning apparatus having the described opening sections, it is possible to improve the throughput of the cleaning apparatus and the yield of liquid crystal display devices manufactured by using this cleaning apparatus. Also, since the cleaning liquid released is re-used by being filtered by the filter, it is possible to use the cleaning liquid efficiently, thus reducing the amount of the cleaning liquid used.

Note that, the arrangement of the opening sections and the inflow amount of the cleaning liquid specified in the present embodiment can also be suitably adopted in the cleaning apparatus 11 of FIG. 3 described in First Embodiment and the cleaning apparatuses 21 and 21*a* of FIG. 5 described in Second Embodiment.

Further, in the present embodiment, the opening section of the nozzle of the inflow opening has a circular shape (round shape) or rectangular shape (square shape). However, not limiting to this, it is possible to suitably adopt an opening section of a regular polygon of a regular pentagon or larger, or alternatively a convex polygon whose internal angles are all less than 180°.

Also, as long as the maximum width of each of the plurality of opening sections constituting each inflow opening is in a range of not less than 2 mm and not more than 5 mm, the shape thereof is not particularly limited provided that it is not unusually irregular. However, a circle or rectangle is particularly preferable.

Also, the arrangement of the opening sections and the specified range of the inflow amount of the cleaning liquid flowing in from the opening sections are not just limited to the cleaning apparatuses having the arrangements of First and Second Embodiment but can also be adopted in a wide range of cleaning apparatuses having a cleaning tank capable of storing a cleaning target, a plurality of opening sections for introducing a fluid into the cleaning tank, and one or more outflow openings for releasing the fluid out of the cleaning tank.

For example, in First and Second Embodiment, it is preferable that the cleaning tank has a substantially rectangular parallelopiped shape. However, the arrangement of the opening sections and the specified range of the inflow amount of the cleaning liquid can also be adopted to a cleaning apparatus having a cleaning tank with a shape other than the rectangular parallelopiped shape. Also, the arrangement of the opening sections and the specified range of inflow amount of the cleaning liquid in the present embodiment are not limited by the positioning of the inflow openings.

The following will describe the cleaning effect of the cleaning methods and the cleaning apparatuses of First and Second Embodiment further in detail based on Examples and Comparative Examples.

EXAMPLE 1

Using the cleaning apparatus 1 of FIG. 1 and FIG. 2 as described in First Embodiment, ten glass substrates 8 (cleaning target), each having a size of 400 mm×500 mm, to be used for liquid crystal display devices were cleaned. As the cleaning liquid (fluid), deionized water was used. The inflow amount of the deionized water from each inflow opening of the cleaning apparatus 1 was set to 100 liters/min. Other conditions such as positioning and shapes of the inflow and outflow openings and the inflow angle of deionized water at each inflow opening are omitted here since they are described in detail in First Embodiment.

Figure 6A:
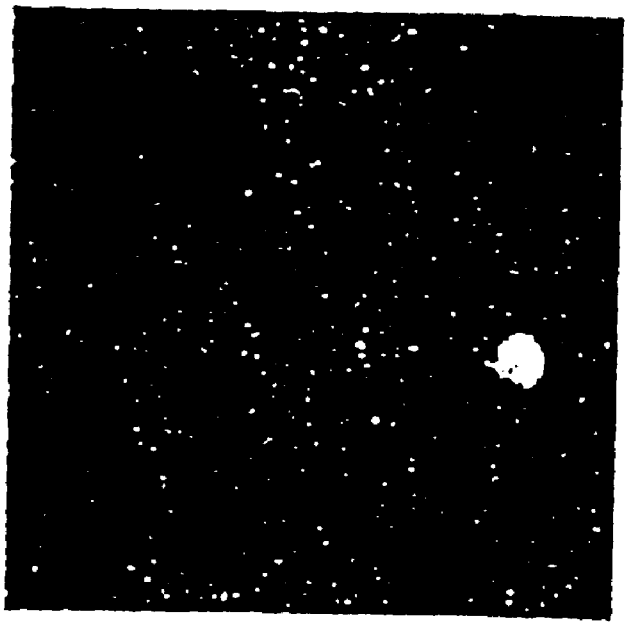
FIG. 6(*a*) is a drawing showing a particle concentration of a glass substrate when cleaned by the cleaning apparatus of FIG. 1.
Figure 6B:
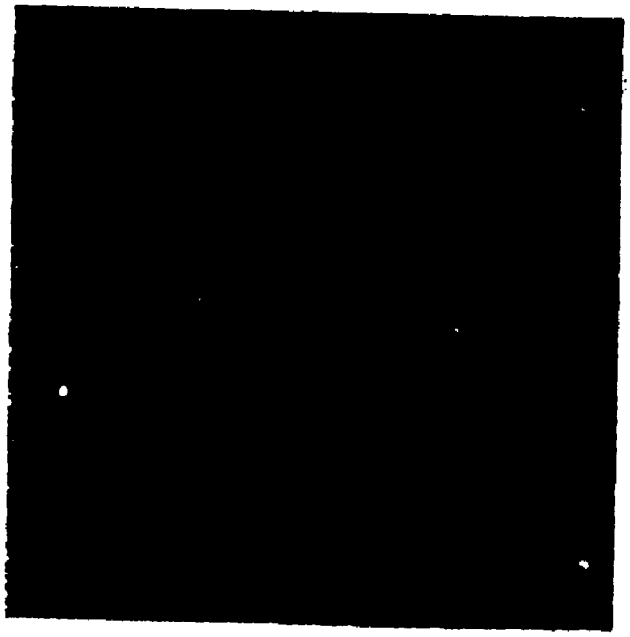

Ten glass substrates 8 were cleaned for 10 minutes using the cleaning apparatus 1, and thereafter the glass substrates 8 were taken out of the cleaning tank 3. After drying the glass substrates 8 taken out of the cleaning tank 3, the number of particles on the glass substrates 8 were measured using the particle measuring device provided by Hitachi Electronics Engineering Co., Ltd. (product No. GI-4700). FIG. 6(*a*) shows the result of measurement.

EXAMPLE 2

Ten glass substrates 8 were cleaned in the same manner as in Example 1 except that the cleaning apparatus 21*a* of FIG.

5 described in Second Embodiment was used. Here, the inflow angle of the deionized water at the second inflow opening 24*b* of the cleaning apparatus 21*a* was set to 45°, and the inflow angle of the deionized water at the fourth inflow opening 25*b* was set to 0°. The inflow amount of the deionized water from each inflow opening was set to 100 liters/min except for the fifth inflow opening 25*c* for which the inflow amount of the deionized water was set to 5 liters/min. Other conditions such as positioning and shapes of the inflow and outflow openings are omitted here since they are described in detail in Second Embodiment. The number of particles on the glass substrates 8 after cleaning was measured in the same manner as in Example 1. FIG. 6(*b*) shows the result of measurement.

COMPARATIVE EXAMPLE 1

Figure 7:
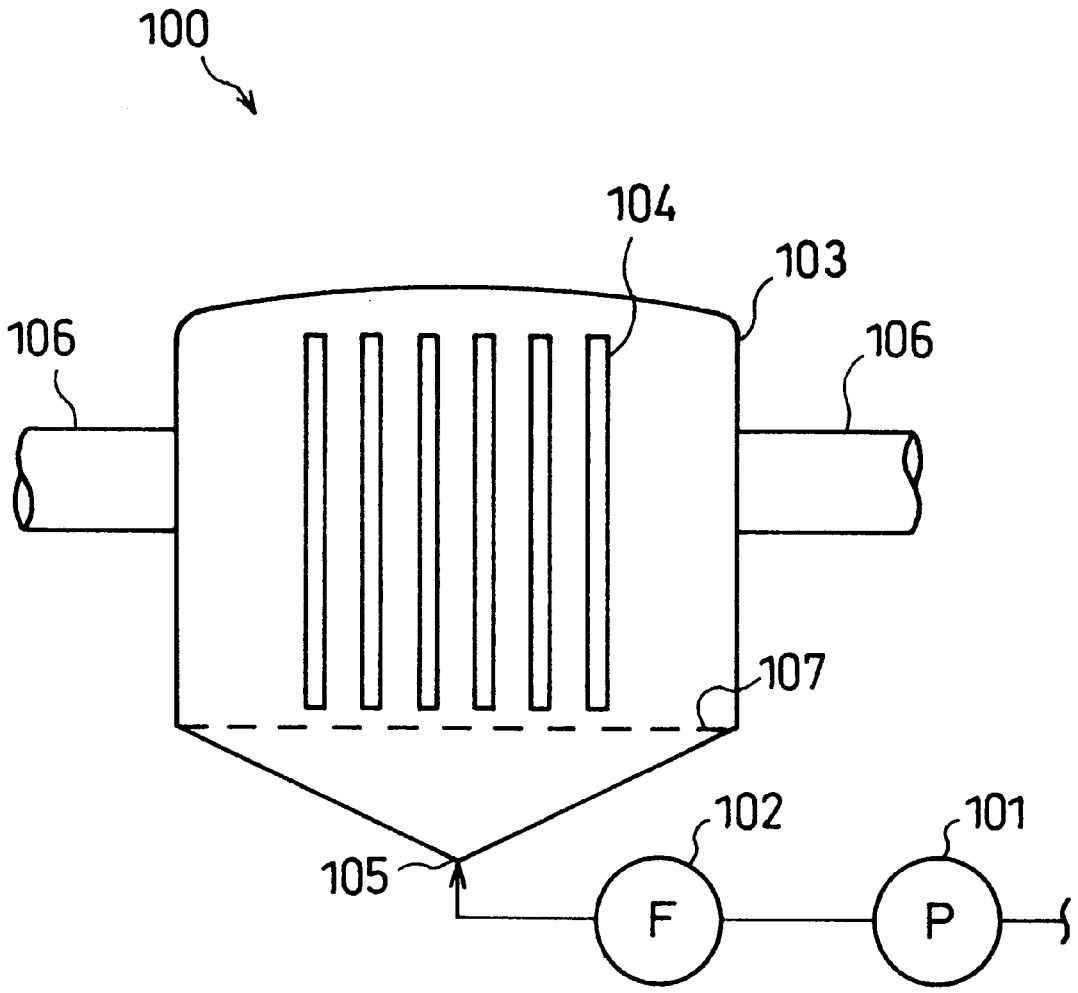
FIG. 7 is an explanatory drawing showing an arrangement of a conventional cleaning apparatus of the overflow system.
Figure 8:
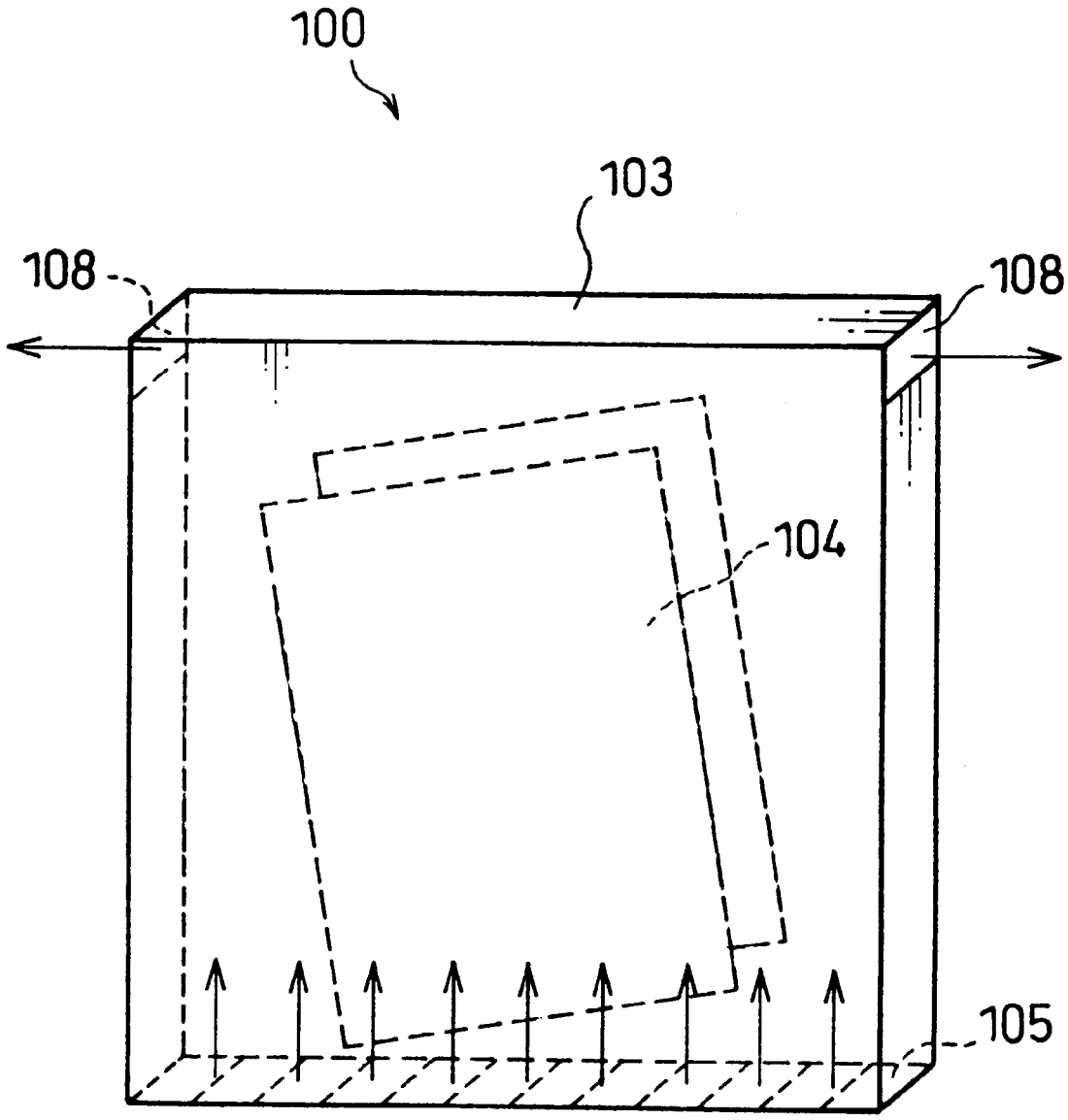
FIG. 8 is an explanatory drawing showing an arrangement of a cleaning tank of the cleaning apparatus of the overflow system.
Figure 16A:
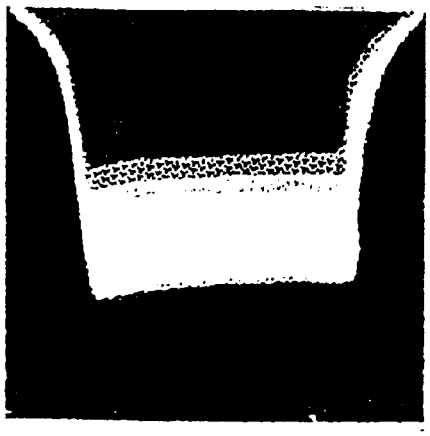
FIG. 16(*a*) is a drawing showing a particle concentration of a glass substrate when cleaned by the cleaning apparatus of FIG. 7.
Figure 16B:
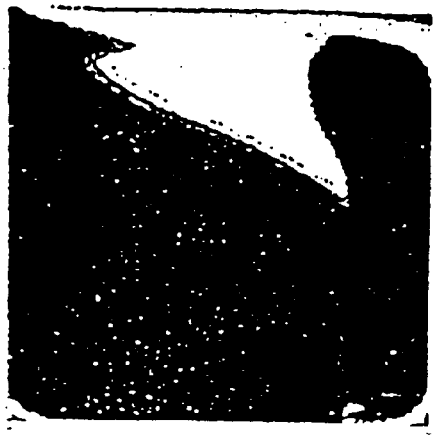
Figure 16C:
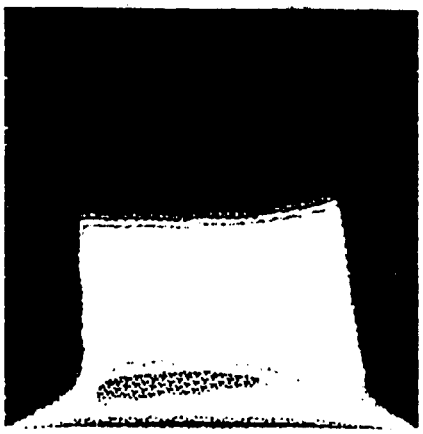

Using the conventional cleaning apparatus 100 of the overflow system as shown in FIG. 7 and FIG. 8, ten glass substrates 8 (104 in FIG. 7 and FIG. 8), each having a size of 400 mm×500 mm, to be used for liquid crystal display devices were cleaned as a cleaning target. Deionized water (pure water) was used as the cleaning liquid. An inflow opening 105 of the cleaning apparatus 100 was provided on the bottom surface of a cleaning tank 103, and the inflow amount of the deionized water from the inflow opening 105 was set to 100 liters/min. The cleaning tank 103 has a size of 600 mm (width)×600 mm (depth)×600 mm (height). Two outflow openings 108 similar to the outflow openings 6*a* and 6*b* of the cleaning apparatus 1 of First Embodiment were provided on the facing side surfaces on the upper end portions of the cleaning tank 103. The number of particles on the glass substrates 8 after cleaning was measured in the same manner as in Example 1. FIG. 16(*a*) shows the result of measurement.

COMPARATIVE EXAMPLE 2

Figure 9:
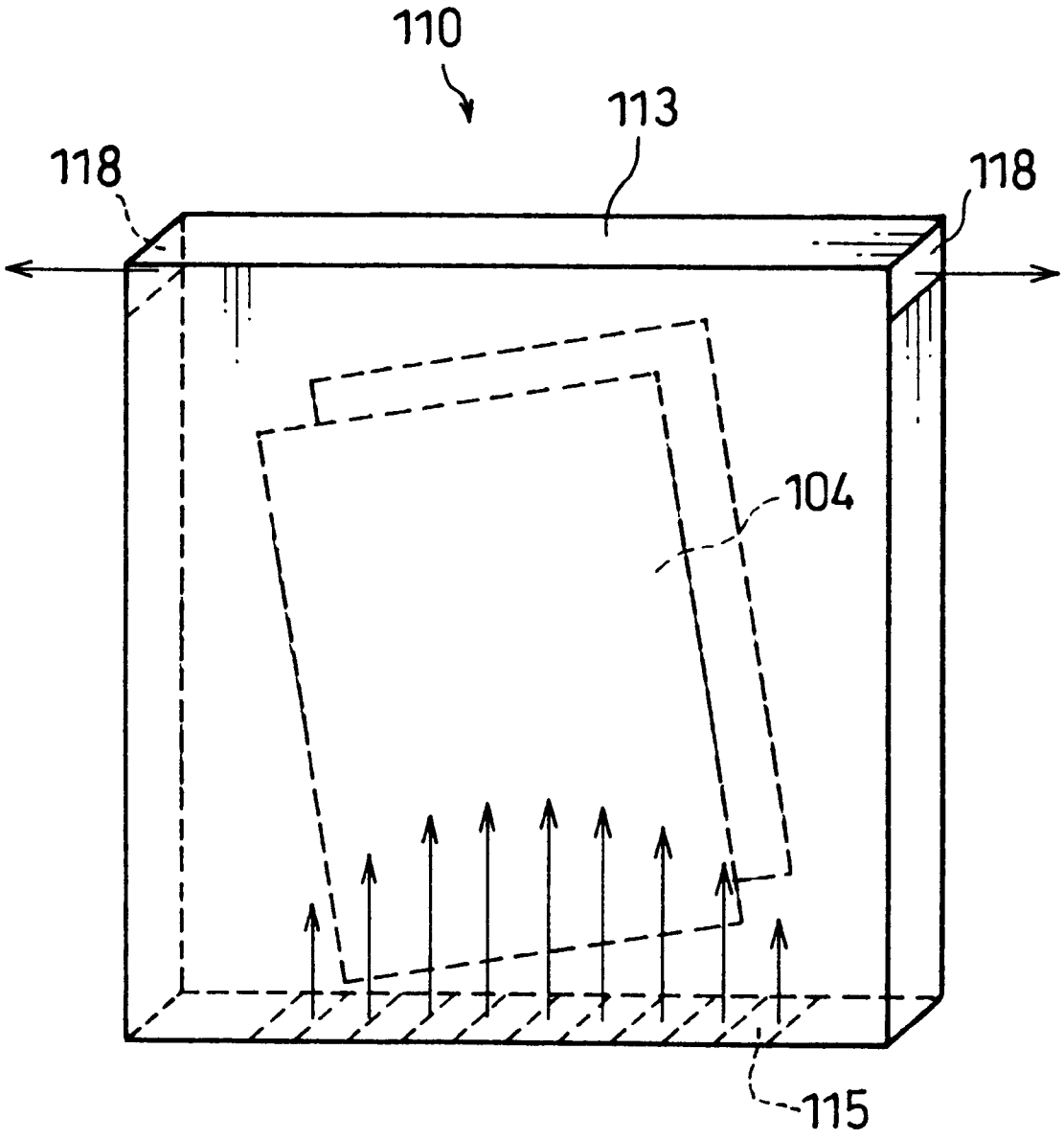
FIG. 9 is an explanatory drawing showing another arrangement of the cleaning tank of the conventional cleaning apparatus of the overflow system.

The glass substrates 8 were cleaned in the same manner as in Comparative Example 1 except that the conventional cleaning apparatus 110 of the overflow system as shown in FIG. 9 was used. The arrangement of the cleaning apparatus 110 and the cleaning conditions are the same as that described in Comparative Example 1 and therefore explanations thereof are omitted here except to note that the deionized water spreads radially from inflow openings 115. The number of particles on the glass substrates 8 after cleaning was measured in the same manner as in Example 1. FIG. 16(*b*) shows the result of measurement.

COMPARATIVE EXAMPLE 3

Figure 10:
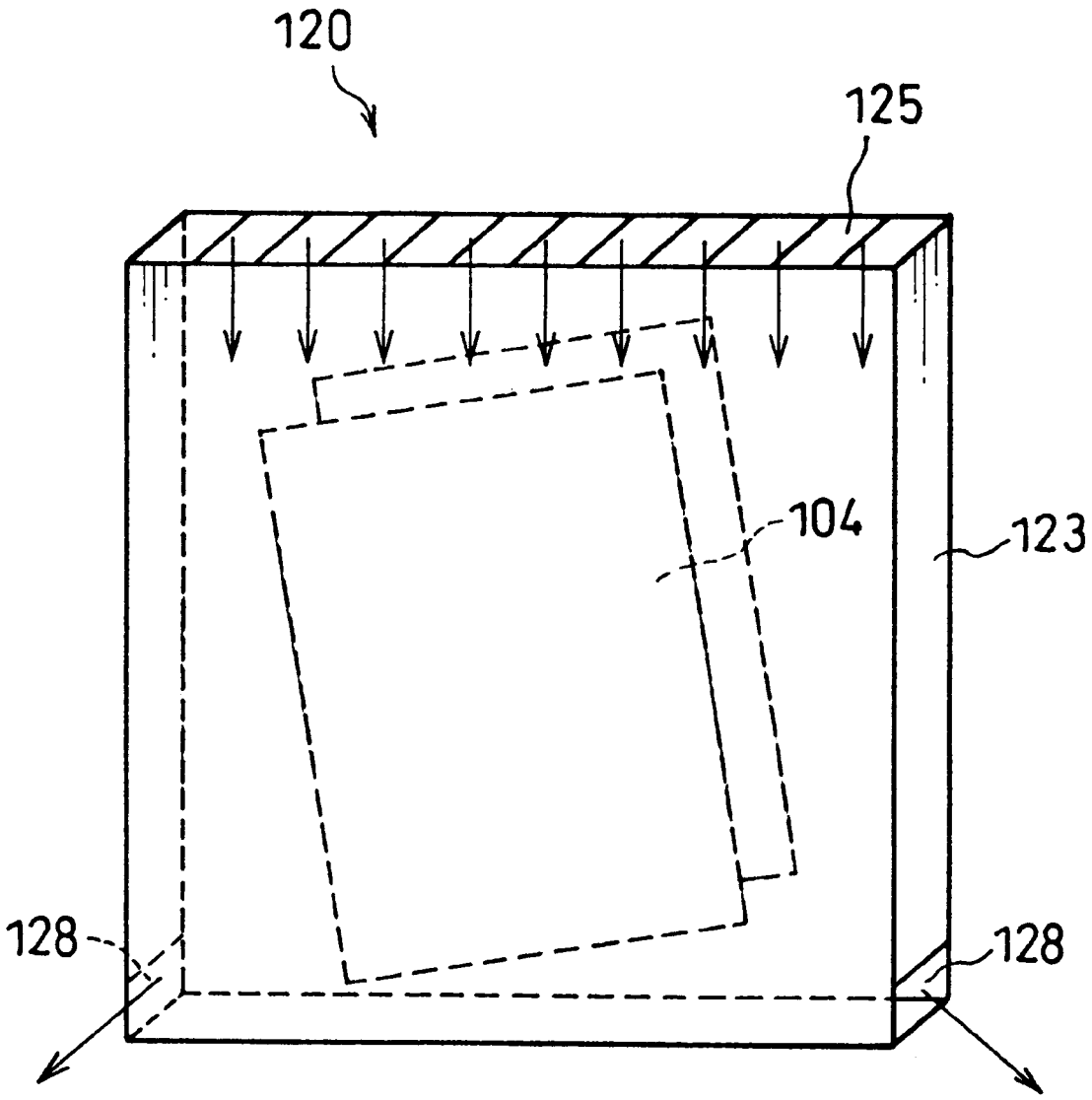
FIG. 10 is an explanatory drawing showing yet another arrangement of the cleaning tank of the conventional cleaning apparatus of the overflow system.

The glass substrates 8 were cleaned in the same manner as in Comparative Example 1 except that the conventional cleaning apparatus 120 of the overflow system as shown in FIG. 10 was used. The arrangement of the cleaning apparatus 120 and the cleaning conditions are the same as that described in Comparative Example 1 and therefore explanations thereof are omitted here except to note that inflow openings 125 are provided on the upper surface of a cleaning tank 123, and that two outflow openings 128 are provided so as to contact the bottom surface of the cleaning tank 123. The number of particles on the glass substrates 8 after cleaning was measured in the same manner as in Example 1. FIG. 16(*c*) shows the result of measurement.

COMPARATIVE EXAMPLE 4

Figure 11:
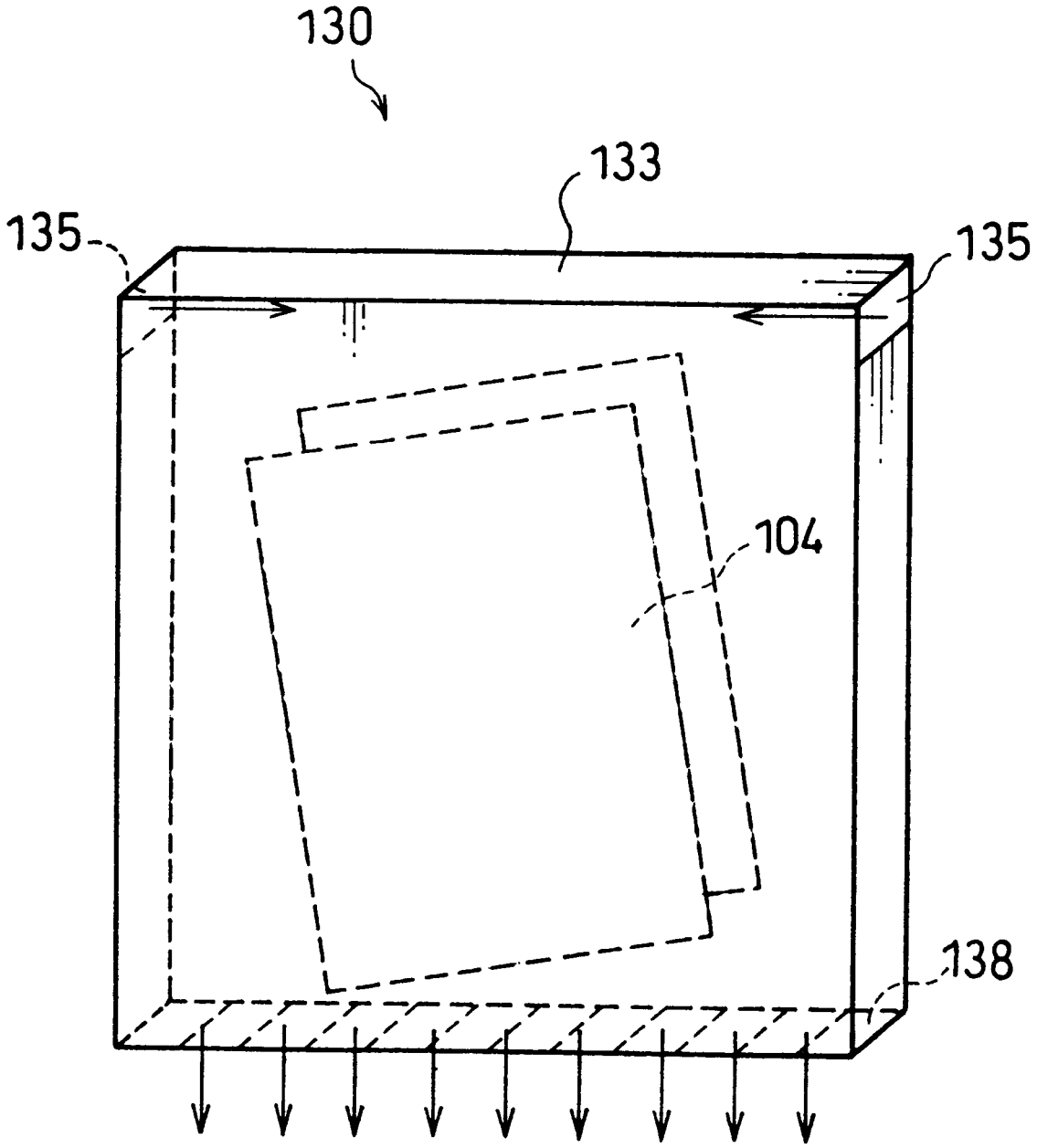
FIG. 11 is an explanatory drawing showing an arrangement of a cleaning tank of a conventional cleaning apparatus of the uniform outflow system.
Figure 12:
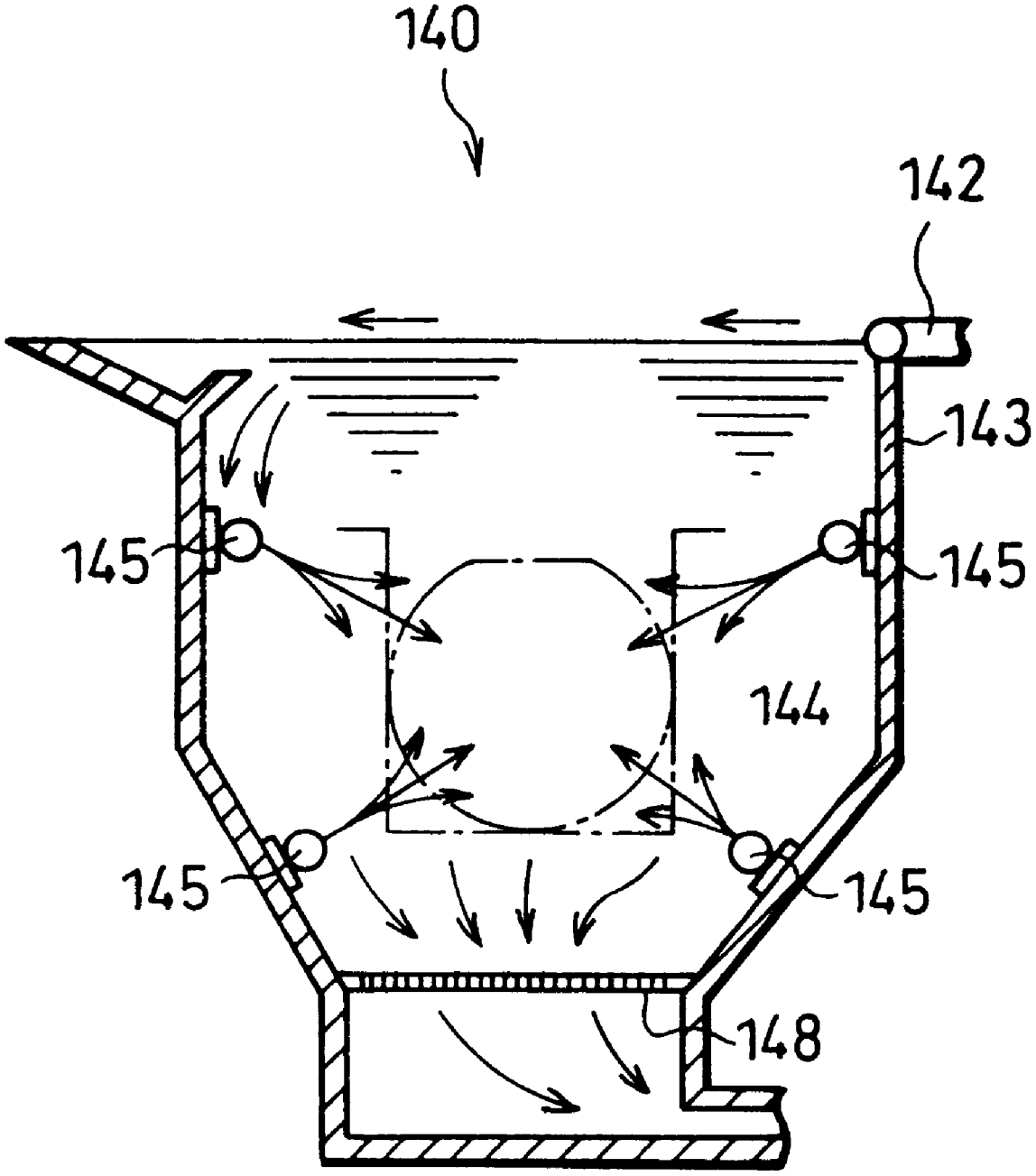
FIG. 12 is an explanatory drawing showing another arrangement of a cleaning tank of a conventional cleaning apparatus of the uniform outflow system.
Figure 13:
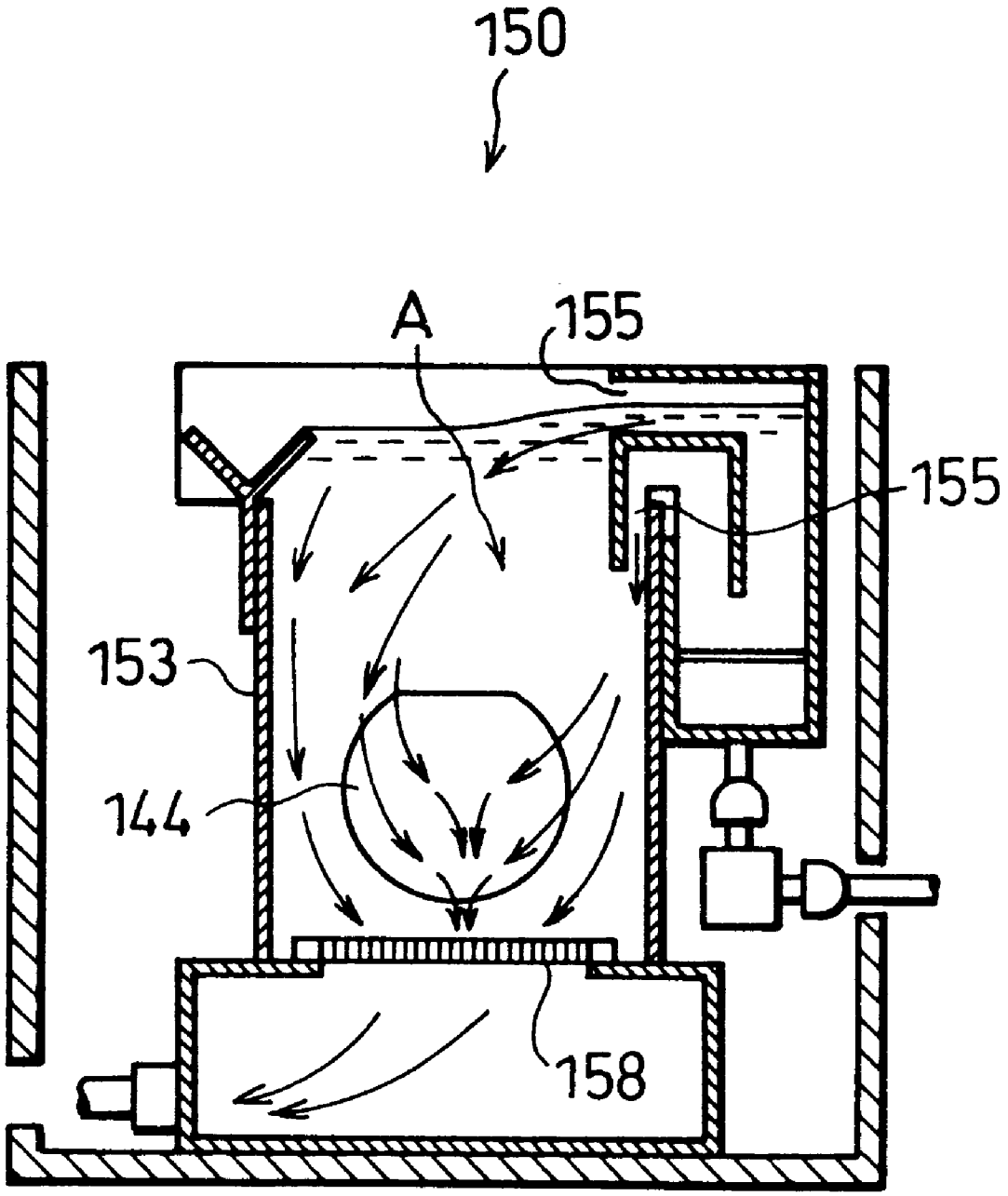
FIG. 13 is an explanatory drawing showing yet another arrangement of a cleaning tank of a conventional cleaning apparatus of the uniform outflow system.
Figure 17A:
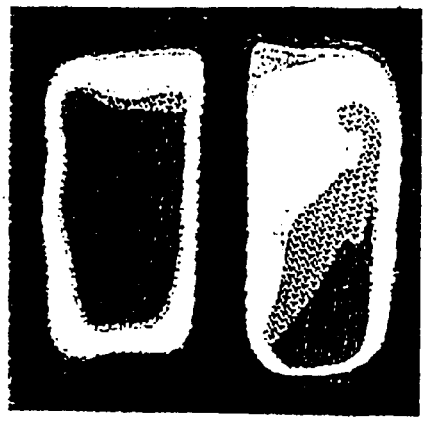
FIG. 17(*a*) is a drawing showing a particle concentration of a glass substrate when cleaned by the cleaning apparatus of FIG. 11.
Figure 17B:
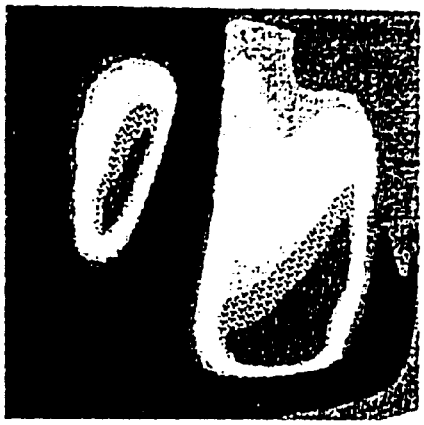
Figure 17C:
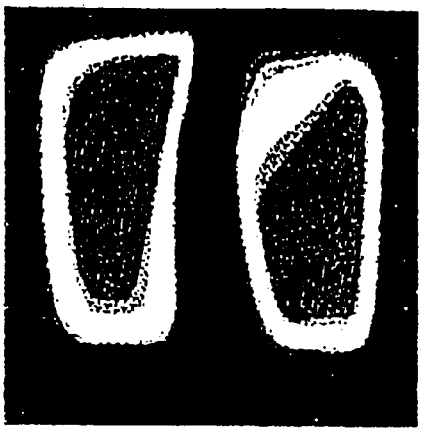

The glass substrates 8 were cleaned in the same manner as in Comparative Example 1 except that the conventional cleaning apparatus 130 of the uniform outflow system as shown in FIG. 11 was used. The arrangement of the cleaning apparatus 130 and the cleaning conditions are the same as that described in Comparative Example 1 and therefore explanations thereof are omitted here except to note that the deionized water flows in from periphery through inflow openings 135, and the inflow amount of the deionized water from the inflow openings 135 is 100 liters/min, and the outflow amount of the deionized water from outflow openings 138 is 100 liters/min. The number of particles on the glass substrates 8 after cleaning was measured in the same manner as in Example 1. FIG. 17(*a*) shows the result of measurement.

COMPARATIVE EXAMPLE 5

Figure 14:
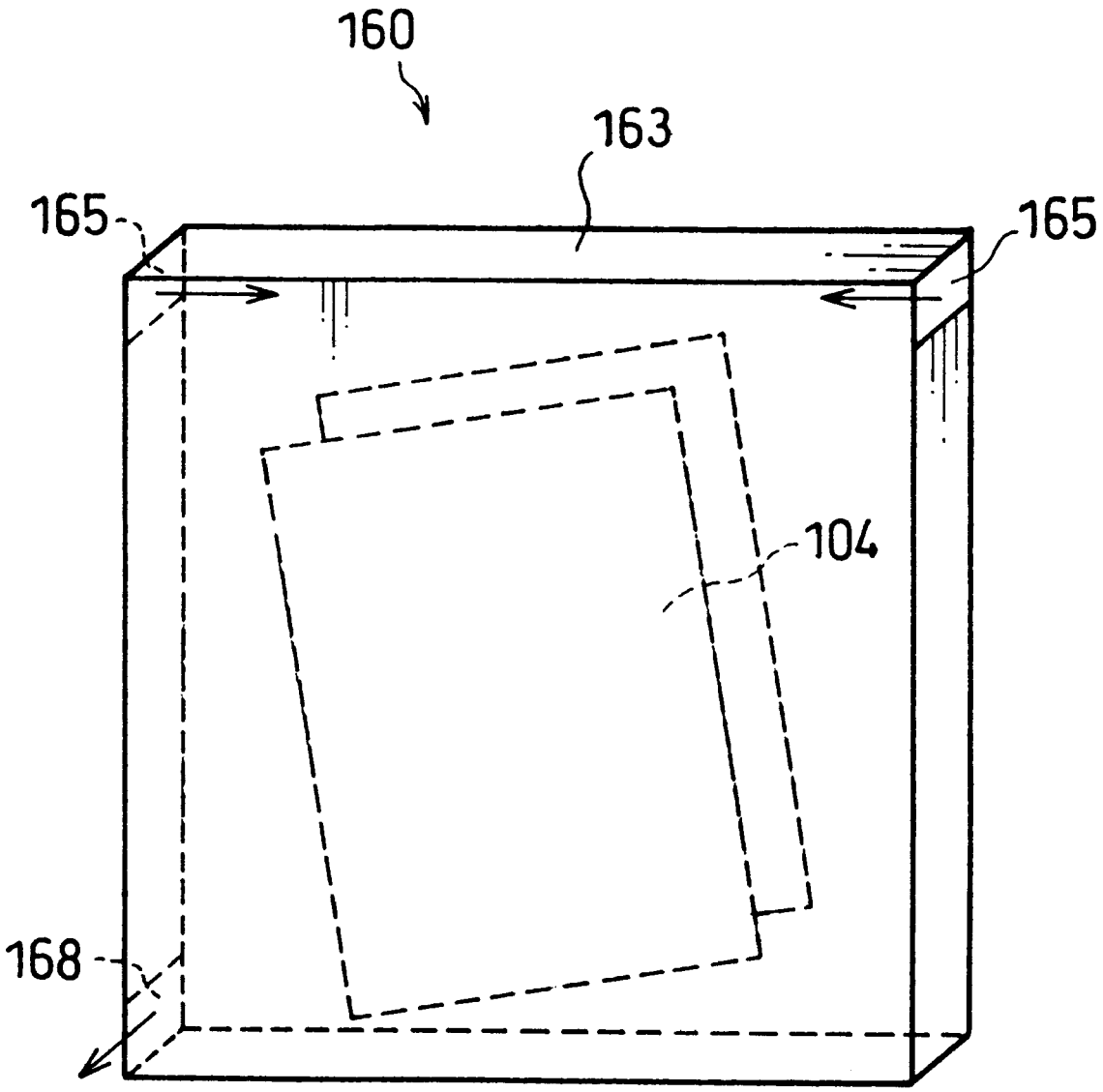
FIG. 14 is an explanatory drawing showing an arrangement of a cleaning tank of a conventional cleaning apparatus of the tornado system.

The glass substrates 8 were cleaned in the same manner as in Comparative Example 1 except that the conventional cleaning apparatus 160 of the tornado system as shown in FIG. 14 was used. The arrangement of the cleaning apparatus 160 and the cleaning conditions are the same as that described in Comparative Example 1 and therefore explanations thereof are omitted here except to note that two inflow openings 165 are provided on the facing side surfaces on the upper end portions of a cleaning tank 163, and that a single outflow opening 168 is provided on the side surface on the lower end portion below one of the inflow openings 165. The number of particles on the glass substrates 8 after cleaning was measured in the same manner as in Example 1. FIG. 17(*b*) shows the result of measurement.

COMPARATIVE EXAMPLE 6

Figure 15:
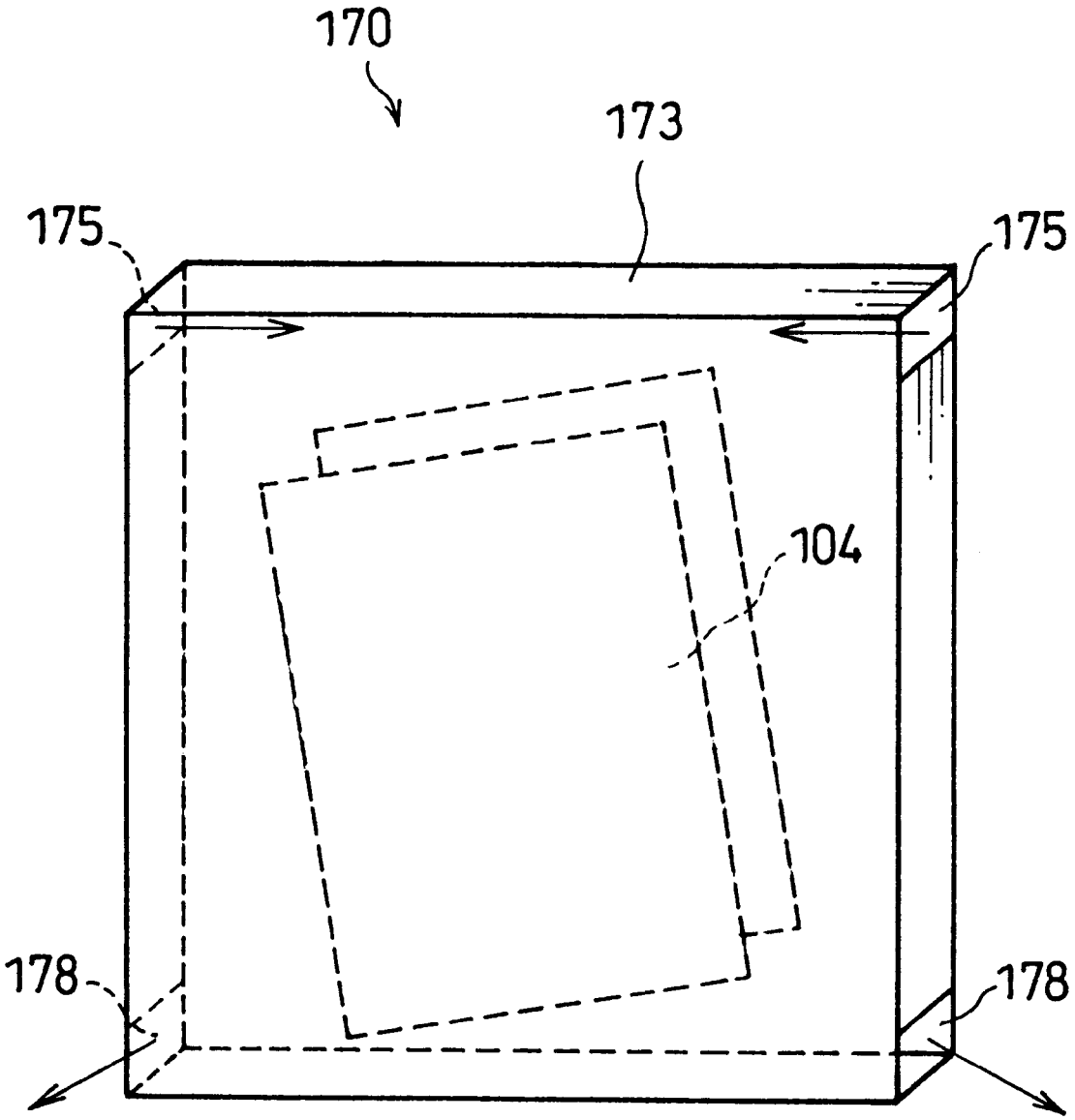
FIG. 15 is an explanatory drawing showing another arrangement of a cleaning tank of a conventional cleaning apparatus of the tornado system.

The glass substrates 8 were cleaned in the same manner as in Comparative Example 1 except that the conventional cleaning apparatus 170 of the tornado system as shown in FIG. 15 was used. The arrangement of cleaning conditions of the cleaning apparatus 160 are the same as that described in Comparative Example 5 and therefore explanations thereof are omitted here except to note that two outflow openings 178 are provided. The number of particles on the glass substrates 8 after cleaning was measured in the same manner as in Example 1. FIG. 17(*c*) shows the result of measurement.

As shown in FIG. 6(*a*) and FIG. 6(*b*), in the cleaning apparatuses 1 and 21*a* of the present embodiment, the particles on the glass substrate 8 are removed evenly and sufficiently with respect to the entire surface without non-uniformity. Especially, in the cleaning apparatus 21*a* provided with the fifth inflow opening 25*c*, almost no particles, as represented by white spots, larger than a predetermined size were observed on the glass substrate 8.

In contrast, as shown in FIG. 16(*a*), FIG. 16(*b*), and FIG. 16(*c*), in the conventional cleaning apparatuses of the overflow system, even when cleaning was carried out under the same conditions as that of the cleaning apparatus of the present invention, stagnation and weak flow of the deionized water were generated in the cleaning tank and it was impossible to evenly remove the particles on the glass substrates 8. Similarly, as shown in FIG. 17(*a*), FIG. 17(*b*), and FIG. 17(*c*), the conventional apparatuses of the uniform outflow system or of the tornado system failed to evenly remove the particles on the glass substrates 8.

On the ten glass substrates 8 cleaned in Example 1, the number of residual particles having a size of not less than 5 μm, which causes a problem in manufacturing of liquid crystal display devices, was only 16 on average. Also, on the glass substrates 8 cleaned in Example 2, the number of residual particles having the above size was only 4 on average.

In contrast, on the ten glass substrates 8 cleaned in each of Comparative Examples 1 through 6, not less than 50 particles remained on average, and as shown in FIG. 16(*a*) through FIG. 16(*c*) and FIG. 17(*a*) through FIG. 17(*c*), nonuniformity of residual particles was observed on the glass substrates 8. Thus, when the liquid crystal display device is manufactured using the conventional cleaning apparatus, the yield of the liquid crystal display devices is reduced. Also, when the number of particles is reduced to a number which does not have an adverse effect in the manufacturing process, the throughput of the liquid crystal display devices is also reduced.

The following describes specifically the results of examination of the size of the plurality opening sections of the inflow opening and the inflow amount of the cleaning liquid flowing from the opening sections in the cleaning method and the cleaning apparatus of Third Embodiment based on Examples.

EXAMPLE 3

A nozzle having ten circular opening sections was adopted as the inflow opening of the cleaning apparatus 1 of FIG. 1 and FIG. 2 described in First Embodiment. Thus, the inflow amount of the cleaning liquid from each opening section is one tenth of the inflow amount of the cleaning liquid from one inflow opening. The inflow amount of the cleaning liquid from one opening section was set to 10 liters/min. Thus, the inflow amount of the cleaning liquid from one inflow opening (nozzle) is 100 liters/min.

The glass substrate 8 having a size of 400 mm×500 mm was cleaned by changing the size of the opening sections of the inflow opening of a nozzle in a range of 1 mm to 6 mm. After 10 minutes of cleaning, the number of particles having a size of not less than 5 $\mu$m on the glass substrate 8 was measured. The measurement was carried out using the Hitachi Electronics Engineering Co., Ltd. product GI-4700 as in Example 1. Table 1 shows the result of measurement. Note that, more than 20,000 particles were present on the glass substrate 8 prior to cleaning.

TABLE 1

| Diameter of Opening Section (mm) | 1 | 2 | 3 | 4 | 5 | 6 |
|---|---|---|---|---|---|---|
| The Number of Particles | 80 | 40 | 20 | 20 | 40 | 80 |

As is clear from the result of Table 1, by setting the diameter of the opening section in a range of 2 mm to 5 mm, the number of residual particles can be reduced effectively. Also, when the diameter of the opening section is set in a range of 3 mm to 4 mm, the number of residual particles is reduced further effectively.

Note that, although not shown specifically, when the shape of the opening section was rectangle rather than circle, the result similar to that of Table 1 was obtained. From this, it can be seen that as the diameter of the opening section, a range of 2 mm to 5 mm, more preferably a range of 3 mm to 4 mm is preferable.

EXAMPLE 4

In the arrangement of Example 3, a nozzle whose circular opening section has a diameter of 3 mm was adopted as the inflow opening. Also, the inflow amount of the cleaning liquid from the opening section, which was fixed in Example 3, was varied. The glass substrate 8 having a size of 400 mm×500 mm was used as a cleaning target as in Example 3 so as to carry out cleaning, and the number of particles on the glass substrate 8 was measured after 10 minutes of cleaning. Table 2 shows the result of measurement.

TABLE 2

| Inflow Amount (liter/min) | 0.5 | 1 | 2.5 | 5 | 20 | 50 | 75 |
|---|---|---|---|---|---|---|---|
| The Number of Particles | 200 | 80 | 40 | 20 | 20 | 40 | 80 |

As is clear from the result of Table 2, by setting the inflow amount of the cleaning liquid from one opening section in a range of 2.5 liters/min to 50 liters/min, the number of residual particles can be reduced effectively. Also, when the inflow amount of the cleaning liquid is set in a range of 5 liters/min to 20 liters/min, the number of residual particles is reduced further effectively.

Note that, although not shown specifically, when the shape of the opening section was rectangle rather than circle, the result similar to that of Table 2 was obtained. From this, it can be seen that as the inflow amount of the cleaning liquid, a range of 2.5 liters/min to 50 liters/min, more preferably a range of 5 liters/min to 20 liters/min is preferable.

As described, with the cleaning apparatus in accordance with the present invention, even a substrate as large as a glass substrate used for liquid crystal display devices can be cleaned efficiently. Therefore, the particles adhering on the glass substrate (cleaning target) can be processed in a short period of time without nonuniformity. As a result, it is possible to prevent lowering of the quality and yield of glass substrates as caused by contamination due to particles and to improve the throughput of liquid crystal display devices and other devices manufactured.

Further, the cleaning effect of the cleaning apparatus in accordance with the present invention can be improved when used in conjunction with the conventionally available ultrasonic cleaning method. In the described embodiment, the glass substrate (cleaning target) is inclined with respect to the bottom surface of the cleaning tank. However, in the cleaning apparatus in accordance with the present invention, a high cleaning effect is obtained even when the cleaning target is not inclined. Note that, the cleaning target is not limited to the glass substrate used for liquid crystal display devices so that silicon wafer, etc., used for manufacturing of ICs and LSIs may be adopted instead.

As described, in the cleaning method in accordance with the present invention, a fluid flows towards the cleaning target from the first side surface and the second side surface facing each other, and the fluid flowing from at least one of the first side surface and the second side surface is plural.

Therefore, by the flows of the fluid, the contaminants on the surfaces of the cleaning target are removed substantially evenly and efficiently, and the contaminants removed from the cleaning target do not remain in the cleaning tank. Thus, with this cleaning method, it is possible to clean efficiently a large cleaning target such as a glass substrate used for liquid crystal display devices.

Also, the cleaning apparatus in accordance with the present invention has the first inflow section and the second inflow section which are provided so as to face each other on the side surfaces of the cleaning tank having a substantially rectangular parallelopiped shape, and at least one of the first inflow section and the second inflow section has a plurality of inflow openings. The plurality of inflow openings on one of the side surfaces are provided at different levels.

With this arrangement, in the cleaning tank, the fluid is prevented from forming a predetermined large flow but instead forms stronger and more complex flows than the conventional flows. As a result, it is possible to effectively prevent stagnation of the cleaning liquid and simple weak flow of the fluid forming a large swirl, and the fluid forms flows with a momentum strong enough for removing the particles in the entire cleaning tank.

In the cleaning apparatus having the above arrangement, it is preferable that the inflow angle of the fluid flowing into the cleaning tank from the inflow openings of the first inflow section is different from the inflow angle of the fluid flowing into the cleaning tank from the inflow openings of the second inflow section.

With this arrangement, since the inflow angles at the inflow openings are different, the fluid forms even more complex flows in the cleaning tank, thus preventing further effectively the stagnation and weak flow of the fluid in the cleaning tank.

In the cleaning tank having the above arrangement, it is preferable that the inflow openings of the first inflow section and the inflow openings of the second inflow section are provided on different levels with respect to the bottom surface of the cleaning tank.

With this arrangement, since the inflow openings are provided on different levels from the bottom surface of the cleaning tank, the fluid forms even more complex flows in the cleaning tank, thus preventing further effectively the stagnation and weak flow of the fluid in the cleaning tank.

In the cleaning apparatus having the above arrangement, it is preferable that at least one of the plurality of inflow openings of the first inflow section and the second inflow section is provided on a position contacting the bottom surface of the cleaning tank.

With this arrangement, since at least one of the inflow openings is provided on a position contacting the bottom surface of the cleaning tank, the fluid forms strong flows in the vicinity of the bottom surface of the cleaning tank, thus effectively preventing the stagnation and weak flow of the fluid, which is likely to occur in the vicinity of the bottom surface of the cleaning tank.

In the cleaning apparatus having the above arrangement, it is preferable that the outflow openings for releasing the cleaning liquid out of the cleaning tank are provided in plurality above the first inflow section and the second inflow section with respect to the bottom surface of the cleaning tank, more preferably on a position contacting the upper surface of the cleaning tank. It is also preferable that the outflow openings are provided for each of the first side surface and the second side surface.

With this arrangement, the cleaning liquid flown into the cleaning tank flows from the lower portion towards the upper portion of the cleaning tank where the plurality of outflow openings are provided. However, because the cleaning liquid tends to flow downward towards the lower portion of the cleaning tank by the force of gravity, the flows of the cleaning liquid become more complex. Further, since at least two outflow openings are provided, compared with the case where only a single outflow opening is provided, the flows of the cleaning liquid become even more complex. As a result, it is possible to prevent further effectively the stagnation and weak flow of the cleaning liquid in the cleaning tank.

In another cleaning method in accordance with the present invention, as described, the fluid flows directly beside the cleaning target from the first side surface of the cleaning tank, and the fluid flows in the vicinity of the bottom surface of the cleaning tank from the second side surface facing the first side surface, and the fluid flowing from at least one of the first side surface and the second side surface is plural.

Also, in the arrangement of the plurality of outflow openings for releasing the fluid out of the cleaning tank, which are provided on positions contacting the upper ends of the cleaning tank, it is preferable that an additional flow of the fluid is formed in the vicinity of the outflow opening provided on the second side surface.

This prevents stagnation of the fluid in the cleaning tank, and the fluid forms flows with a momentum strong enough for removing the particles in the entire cleaning tank. Thus, with this cleaning method, it is possible to clean efficiently a large cleaning target such as the glass substrate used for liquid crystal display devices.

As described, in another cleaning apparatus in accordance with the present invention having the first inflow section and the second inflow section which are provided so as to face each other on the side surfaces of the cleaning tank having a substantially rectangular parallelopiped shape, two inflow openings of the first inflow section are provided directly beside the cleaning target, and one of the two inflow openings of the second inflow section is provided so as to contact the bottom surface of the cleaning tank, and another inflow opening is provided in the vicinity directly above the inflow opening contacting the bottom surface of the cleaning tank.

With this arrangement, the fluid flows in from positions in the vicinity directly beside the upper end and lower end of the inclined cleaning target. As a result, the flows of the cleaning liquid become more complex in the cleaning tank while maintaining the momentum, and the stagnation of the cleaning liquid is effectively prevented, thus improving the cleaning effect.

Further, since the cleaning target is inclined, the cleaning liquid is removed with ease when taking the cleaning target out of the cleaning tank. As a result, it is possible to effectively prevent the particles from remaining on the cleaning target.

It is preferable that the above cleaning apparatus has an arrangement wherein the first inflow section has the first inflow opening provided below the central portion of the inclined cleaning target and the second inflow opening provided above the central portion, and the second inflow section has a third inflow opening provided on a position contacting the bottom surface of the cleaning tank and the fourth inflow opening provided on substantially the same level as the lower end of the cleaning target with respect to the bottom surface of the cleaning tank.

With this arrangement, the flows of the fluid do not cancel out each other on the cleaning target and become more complex, thus effectively preventing the stagnation and weak flow of the fluid. Also, by the third inflow opening, the stagnation and weak flow of the fluid, which are likely to occur in the vicinity of the bottom surface of the cleaning tank, are effectively prevented.

In the above cleaning apparatus, it is preferable that the fluid from the first inflow opening flows in a direction substantially parallel to the bottom surface of the cleaning tank, and the fluid from the second inflow opening flows in an inclined direction down towards the bottom surface of the cleaning tank, and the fluid from the third inflow opening flows in a direction substantially parallel to the bottom surface of the cleaning tank, and the fluid from the fourth inflow opening flows in a direction substantially parallel to the second side surface.

With this arrangement, since the fluid flows downward in an inclined direction from the second inflow opening, the fluid forms two flows of (a) a flow from the first inflow section for cleaning the cleaning target from directly beside it and (b) a flow for cleaning the cleaning target in an inclined direction. These flows do not cancel out each other by the flows from the inflow openings of the second inflow section and form complex flows, thus effectively preventing the stagnation and weak flow of the fluid.

Also, the fluid flows from the fourth inflow opening in a direction substantially parallel to the second side surface, namely, the fluid forms a flow along the second side surface. Thus, stagnation and weak flow of the fluid are also prevented effectively in the vicinity of the second side surface.

It is preferable that the above cleaning apparatus has an arrangement wherein the second inflow section is further provided with an additional inflow opening (fifth inflow opening) in the vicinity of one of the plurality of outflow openings.

With this arrangement, by the flow of the fluid from the fifth inflow opening, the contaminants removed from the cleaning target, which tend to remain in the vicinity of the fluid surface on the upper portion of the cleaning tank, are effectively removed. Therefore, the cleaning target is prevented from being contaminated again by the residual contaminants when taking the cleaning target out of the cleaning tank after cleaning. Also, by the flow of the fluid from the fifth inflow opening, the stagnation and weak flow of the fluid are effectively prevented in a region above the cleaning target placed in the cleaning tank.

In the above cleaning apparatus, it is preferable that the inflow amount of the fluid from the fifth inflow opening is less than the inflow amount of any of the other inflow openings.

With this arrangement, since the inflow amount of the fluid from the fifth inflow opening is small, the flow of the fluid from the fifth inflow opening is slightly weaker than the flow of the fluid from any of the other inflow openings. As a result, it is possible to effectively remove the contaminants removed from the cleaning target, which tend to remain in the vicinity of the fluid surface on the upper portion of the cleaning tank, without disturbing the other flows of the fluid.

It is preferable that the above cleaning apparatus is further provided with circulatory means for filtering the fluid released from the plurality of outflow openings and allowing the fluid released to flow into the cleaning tank again from the inflow openings of the first inflow section and the second inflow section.

With this arrangement, the circulatory means removes the contaminants removed from the cleaning target and existing in the fluid released out of the cleaning tank from the outflow openings. Then, the purified fluid from which the contaminants have been removed is allowed to flow into the cleaning tank again by the circulatory means. Thus, the fluid used for cleaning is used efficiently, and since a large amount of fluid is not required, the cost of cleaning is reduced.

In still another cleaning method in accordance with the present invention, as described, the flows of the fluid are formed by the plurality of opening sections having a shape of a circle, rectangle, or any other associated shapes with a maximum width in a range of not less than 2 mm to not more than 5 mm.

With this method, the fluid does not stagnate in the cleaning tank and forms flows with a momentum strong enough for removing the particles in the entire cleaning tank. Therefore, with this cleaning method, it is possible to clean a large substrate such as the glass substrate used for liquid crystal display devices further efficiently.

Also, as described, another cleaning apparatus in accordance with the present invention has an arrangement including a cleaning tank capable of storing the cleaning target, a plurality of opening sections for injecting the fluid into the cleaning tank, and one or more outflow openings for releasing the fluid out of the cleaning tank, wherein each of the outflow openings has a shape of a circle with a diameter of not less than 2 mm and not more than 5 mm, or a rectangle with a side length of not less than 2 mm and not more than 5 mm.

It is particularly preferable that the opening section is a circle with a diameter of not less than 3 mm and not more than 4 mm, or a rectangle with a side length of not less than 3 mm and not more than 4 mm.

With this arrangement, the flows of the fluid are flown with a momentum and the contaminants on the cleaning target are removed effectively. As a result, the throughput in the cleaning process is improved.

In the above cleaning apparatus, it is preferable that the inflow amount from each opening section is not less than 2.5 liters/min and not more than 50 liters/min, more preferably not less than 5 liters/min and not more than 25 liters/min.

With this arrangement, the cleaning effect and the throughput in the cleaning process are further improved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cleaning method comprising the steps of:

flowing a fluid into a cleaning tank having a substantially rectangular parallelopiped shape via at least first, second and third fluid flows;

the first fluid flow flowing into the cleaning tank from a first side surface of the cleaning tank and the second fluid flow flowing into the cleaning tank from a second side surface facing the first side surface so that flows of the fluid in opposite directions to each other are produced in the cleaning tank, said fluid flows flowing towards a cleaning target which is stored in the cleaning tank, so that the fluid flows throughout the cleaning tank;

the third fluid flow flowing into the tank from one of the first and second side surfaces so that the fluid flowing into the tank from at least one of the side surfaces includes plural fluid flows at different elevations or heights relative to a bottom surface of the tank; and releasing the fluid out of the cleaning tank after cleaning the cleaning target.

2. The cleaning method as set forth in claim 1, wherein a direction of the fluid flowing in from the first side surface and a direction of the fluid flowing in from the second side surface are different.

3. The cleaning method as set forth in claim 1, wherein the fluid flowing in from the first side surface and the fluid flowing in from the second side surface are at different levels with respect to a bottom surface of the cleaning tank.

4. The cleaning method as set forth in claim 1, wherein the fluid flowing in from at least one of the first side surface and the second side surface flows in from a position contacting the bottom surface of the cleaning tank.

5. The cleaning method as set forth in claim 1, wherein the fluid is released out of the cleaning tank after cleaning the cleaning target from a position higher than a position from which the fluid flows in with respect to the bottom surface of the cleaning tank.

6. The cleaning method as set forth in claim 1, wherein the fluid released is filtered, and the fluid filtered is flown into the cleaning tank again.

7. The cleaning method as set forth in claim 1, wherein the cleaning target stored in the cleaning tank is inclined with respect to the cleaning tank.

8. A cleaning method comprising the steps of:

storing a cleaning target in a cleaning tank in an inclined manner, the cleaning tank having a substantially rectangular parallelopiped shape;

flowing fluid into the tank in a first fluid flow from a position in a region on a first side surface in a vicinity of an upper end of the cleaning target, the region corresponding to a distance between the upper end and a lower end of the cleaning target flowing the fluid into the tank in a second fluid flow from a position on a second side surface facing the first side surface, in a vicinity of the lower end of the cleaning target, so that the fluid flows throughout the cleaning tank and so that flows of the fluid in opposite directions to each other are produced in the cleaning tank;

releasing the fluid out of the cleaning tank after cleaning the cleaning target from a plurality of outflow openings provided on an upper end of the cleaning tank; and wherein fluid flowing in from at least one of the first side surface and the second side surface includes plural fluid flows so that a third fluid flow is provided on at least one of said first and second side surfaces and the plural fluid flows at the at least one side surface are at different elevations or heights relative to a bottom surface of the cleaning tank.

9. The cleaning method as set forth in claim 8, wherein an inclined angle of the cleaning target stored in the cleaning tank is in a range of 10° to 30°.

10. A cleaning apparatus, comprising:

a cleaning tank having a substantially rectangular parallelopiped shape with a region for storing a cleaning target;

a first inflow section, provided on a first side surface of said cleaning tank, for allowing a fluid to flow into said cleaning tank;

a second inflow section, provided on a second side surface facing the first side surface, for allowing the fluid to flow into said cleaning tank so that flow of fluid in opposite directions to each other are provided in the cleaning tank and so that fluid flows throughout the tank;

an outflow opening for releasing the fluid flowing in from said first inflow section and said second inflow section; and where at least one of said first inflow section and said second inflow section has a plurality of inflow openings whose heights from a bottom surface of said cleaning tank are different from one another.

* * * * *

UNITED STATES PATENT AND TRADEMARK OFFICE

CERTIFICATE OF CORRECTION

PATENT NO. : 6,132,523
DATED : October 17, 2000
INVENTOR(S) : Okuda et al.

It is certified that error appears in the above-identified patent and that said Letters Patent is hereby corrected as shown below:

On the Title Page:
Item [75] Inventors should read: Tohru Okuda, Taimi Oketani, Masatoshi Hayashi Signed and Sealed this Twelfth Day of June, 2001

Nicholas P. Godici

*Attest:*

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,132,523
DATED : October 17, 2000
INVENTOR(S) : Okuda et al.

It is certified that error appears in the above-identified patent and that said Letters Patent is hereby corrected as shown below:

On the Title Page:
Item [75] Inventors should read: Tohru Okuda, Taimi Oketani, Masatoshi Hayashi Signed and Sealed this Twenty-sixth Day of June, 2001

*Attest:*

Nicholas P. Godici

*Attesting Officer*

NICHOLAS P. GODICI
*Acting Director of the United States Patent and Trademark Office*